US007748246B1

(12) United States Patent
Paige et al.

(10) Patent No.: US 7,748,246 B1
(45) Date of Patent: Jul. 6, 2010

(54) HANDLE AND HOUSING ASSEMBLY

(75) Inventors: Douglas J. Paige, Lakewood, OH (US); Lee S. Weinerman, Medina, OH (US); Paul J. Wolos, Cleveland, OH (US)

(73) Assignee: The Eastern Company

( * ) Notice: Subject to any disclaimer, the term of this patent is extended or adjusted under 35 U.S.C. 154(b) by 0 days.

(21) Appl. No.: 12/290,955

(22) Filed: Nov. 5, 2008

Related U.S. Application Data

(63) Continuation of application No. 11/159,939, filed on Jun. 23, 2005, now Pat. No. 7,454,933, which is a continuation-in-part of application No. 11/079,328, filed on Mar. 14, 2005, now Pat. No. 7,398,664.

(51) Int. Cl.
*E05B 13/10* (2006.01)

(52) U.S. Cl. ..... 70/208; 70/224; 292/207; 292/336.3; 292/DIG. 30; 292/DIG. 31

(58) Field of Classification Search ..... 70/208, 70/209, 210, 211, 224; 292/208, 336.3, DIG. 30, 292/DIG. 31
See application file for complete search history.

(56) References Cited

U.S. PATENT DOCUMENTS

| | | | | |
|---|---|---|---|---|
| 1,035,073 | A | 8/1912 | Augenbraun | 70/150 |
| 1,558,980 | A | 10/1925 | Halinka | 292/166 |
| 2,055,688 | A | 9/1936 | Halinka | 292/153 |
| 2,117,192 | A | 5/1938 | McClung | 292/166 |
| D119,418 | S | 3/1940 | Anderson et al. | D8/306 |
| 2,402,348 | A | 6/1946 | Schroeder | 292/164 |
| 2,729,089 | A | 1/1956 | Pelcin | 70/151 |
| 2,735,706 | A | 2/1956 | Pelcin | 292/34 |
| 2,991,904 | A | 7/1961 | Carideo | 220/44 |
| 3,209,564 | A | 10/1965 | Pelcin | 70/471 |
| 3,333,878 | A | 8/1967 | Pelcin | 292/37 |
| D210,152 | S | 2/1968 | Pastva | D8/341 |
| 3,389,932 | A | 6/1968 | Pastva, Jr. | 292/173 |
| 3,457,744 | A | 7/1969 | Bisbing | 70/82 |
| 3,953,061 | A | 4/1976 | Hansen et al. | 292/5 |
| 4,370,874 | A | 2/1983 | Munn | 70/204 |
| D271,562 | S | 11/1983 | Weinerman | D8/338 |
| 4,589,163 | A | 5/1986 | Weatherby et al. | 16/443 |

(Continued)

*Primary Examiner*—Peter M Cuomo
*Assistant Examiner*—Christopher Boswell
(74) *Attorney, Agent, or Firm*—David A. Burge

(57) ABSTRACT

A handle and housing assembly includes a housing having front and rear sides. A handle is connected on the front side of the housing to a shaft that extends through the housing along a forwardly-rearwardly extending axis. The handle may turn the shaft about the axis to turn components connected to a rear portion of the shaft, and/or the handle may move shaft-connected components forwardly and rearwardly along the axis of the shaft. In some embodiments, the housing defines a forwardly facing recess, and the handle is nestable within and extendable from the recess. In some embodiments, the handle and housing are provided with padlockable formations that extend side by side when the handle is in its nested or retracted position. In some embodiments, rearwardly extending housing-carried formations cooperate with a shaft-connected component to limit the permitted range of turning movement of the shaft about the principal axis, and/or the formations extend along opposite sides of a path of travel followed by a lock bolt to guide the lock bolt as it moves between locked and unlocked positions to selectively prevent and permit turning of the shaft about the principal axis.

20 Claims, 16 Drawing Sheets

U.S. PATENT DOCUMENTS 4,641,865 A 2/1987 Pastva ..... 292/5
4,706,478 A 11/1987 Swan et al. ..... 70/28
4,714,283 A 12/1987 Dignan ..... 292/48
4,838,054 A 6/1989 Weinerman et al. ..... 70/208
D303,617 S 9/1989 Russell et al. ..... D8/306
D303,620 S 9/1989 Russell et al. ..... D8/313
D303,621 S 9/1989 Russell et al. ..... D8/313
D303,922 S 10/1989 Russell et al. ..... D8/321
D304,155 S 10/1989 Russell et al. ..... D8/303
4,892,338 A 1/1990 Weinerman et al. ..... 292/35
D314,131 S 1/1991 Russell et al. ..... D8/321
D316,365 S 4/1991 Hansen et al. ..... D8/331
5,015,019 A 5/1991 Razdolsky ..... 292/200
5,018,373 A 5/1991 Weinerman et al. ..... 70/99
D317,398 S 6/1991 Hansen et al. ..... D8/336
D318,606 S 7/1991 Weinerman et al. ..... D8/331
5,052,869 A 10/1991 Hansen, II ..... 410/111
D323,776 S 2/1992 Hansen ..... D8/338
D323,970 S 2/1992 Schlack ..... D8/341
D324,636 S 3/1992 Schlack et al. ..... D8/331
D328,231 S 7/1992 Hansen ..... D8/301
5,127,686 A 7/1992 Gleason et al. ..... 292/216
D357,396 S 4/1995 Ziemer et al. ..... D8/331
5,409,272 A 4/1995 McCormack ..... 292/66
D364,329 S 11/1995 Ziemer et al. ..... D8/331
D370,620 S 6/1996 Ziemer ..... D8/341
5,526,660 A 6/1996 Bennett et al. ..... 70/208
5,585,578 A 12/1996 Shimotori ..... 84/95.2
5,595,076 A 1/1997 Weinerman et al. ..... 70/208
D389,393 S 1/1998 Hansen ..... D8/310
5,913,908 A 6/1999 Czipri ..... 70/208
D413,056 S 8/1999 Sokurenko et al. ..... D8/331
5,938,248 A 8/1999 Vickers et al. ..... 292/36
5,984,383 A 11/1999 Parikh et al. ..... 292/121
D427,882 S 7/2000 Wytcherley et al. ..... D8/331
D429,141 S 8/2000 Antonucci et al. ..... D8/331
6,109,669 A 8/2000 Pinkow ..... 292/175
D439,500 S 3/2001 Minick ..... D8/352
D442,844 S 5/2001 Mirick ..... D8/301
D455,640 S 4/2002 Hansen ..... D8/352
D456,237 S 4/2002 Sokurenko et al. ..... D8/307
D457,803 S 5/2002 Weinerman et al. ..... D8/338
D459,192 S 6/2002 Weinerman et al. ..... D8/338
D459,973 S 7/2002 Weinerman et al. ..... D8/353
D460,680 S 7/2002 Weinerman et al. ..... D8/353
6,418,761 B1 7/2002 Wytcherley et al. ..... 70/208
D464,863 S 10/2002 Teskey ..... D8/306
6,460,902 B1 10/2002 Kyle ..... 292/165
D465,399 S 11/2002 Weinerman et al. ..... D8/302
D466,789 S 12/2002 Jeffries ..... D8/352
6,490,895 B1 12/2002 Weinerman et al. ..... 70/208
D469,331 S 1/2003 Hansen ..... D8/306
D469,678 S 2/2003 Teskey ..... D8/301
6,513,353 B1 2/2003 Weinerman et al. ..... 70/208
6,530,250 B1 3/2003 Linares et al. ..... 70/208
6,532,778 B2 3/2003 Molzer et al. ..... 70/208
D475,602 S 6/2003 McCloskey ..... D8/331
6,623,052 B2 9/2003 Hansen ..... 292/336.3
D484,024 S 12/2003 Teskey et al. ..... D8/331
D484,025 S 12/2003 Chen ..... D8/331
6,666,053 B2 12/2003 Sadler ..... 70/210
6,668,602 B2 12/2003 Graham et al. ..... 70/208
6,709,030 B2 3/2004 Furlong ..... 292/121
D488,052 S 4/2004 Hansen ..... D8/352
D488,702 S 4/2004 Hansen ..... D8/350
D488,994 S 4/2004 Hansen ..... D8/350
D489,958 S 5/2004 Jackson et al. ..... D8/331
D489,959 S 5/2004 Jackson et al. ..... D8/331
D490,292 S 5/2004 Hansen ..... D8/352
D497,098 S 10/2004 Magnusson ..... D8/331
D501,129 S 1/2005 Hansen ..... D8/321
D501,393 S 2/2005 Hansen ..... D8/321
D506,120 S 6/2005 Straka, Jr. et al. ..... D8/331
6,952,940 B2 10/2005 Molzer et al. ..... 70/210
D519,823 S 5/2006 Pickar et al. ..... D8/331
D520,336 S 5/2006 Hansen ..... D8/321
D523,726 S 6/2006 Weinerman et al. ..... D8/307
7,124,475 B2 10/2006 Jeffries ..... 16/445
D531,484 S 11/2006 Downing ..... D8/331
D537,321 S 2/2007 Paige et al. ..... D8/338
D546,165 S 7/2007 Paige et al. ..... D8/338
D556,538 S 12/2007 Weinerman et al. ..... D8/330
D567,061 S 4/2008 Paige et al. ..... D8/321
7,454,933 B1 * 11/2008 Paige et al. ..... 70/208
2003/0111848 A1 6/2003 Hansen ..... 70/208
2004/0083780 A1 5/2004 Graham et al. ..... 70/208
2005/0257582 A1 11/2005 Minix ..... 70/208
2006/0185408 A1 8/2006 Graham et al. ..... 70/208

* cited by examiner

HANDLE AND HOUSING ASSEMBLY

REFERENCE TO RELATED AND RELEVANT APPLICATIONS

The present application is a continuation of application Ser. No. 11/159,939 filed Jun. 23, 2005 now U.S. Pat. No. 7,454,933 by Lee S. Weinerman et al entitled HANDLE AND HOUSING ASSEMBLY, which was a continuation-in-part of application Ser. No. 11/079,328 filed Mar. 14, 2005 by Lee S. Weinerman et al entitled HANDLE AND HOUSING ASSEMBLY and issued Jul. 15, 2008 as U.S. Pat. No. 7,398,664 (referred to hereinafter as the "Parent Patent"), the disclosures of all of which are incorporated herein by reference.

Reference also is made to the following subject matter related design patents of Lee S. Weinerman et al which disclose appearance features that may be utilized in the practice of the present invention, the disclosures of which also are incorporated herein by reference, namely:

D-537,321 issued Feb. 27, 2007;
D-538,131 issued Mar. 13, 2007;
D-546,165 issued Jul. 10, 2007;
D-548,561 issued Aug. 14, 2007;
D-567,061 issued Apr. 22, 2008; and,
D-578,373 issued Oct. 14, 2008.

BACKGROUND OF THE INVENTION

The specification of this continuation application is intended to be identical to the specification of predecessor application Ser. No. 11/159,939 filed Jun. 23, 2005. The term "present invention" as utilized herein has the same meaning as in the predecessor application.

The present invention relates to handle and housing assemblies that can be used to operate devices such as latches that retain closures in closed positions. More particularly, the present invention relates to handle and housing assemblies that employ a housing having a front side and a rear side, and a handle that is connected on the front side of the housing to a shaft that extends through the housing along a forwardly-rearwardly extending principal axis of the housing, wherein the handle is graspable 1) to turn the shaft and components connected thereto about the principal axis between first and second orientations, 2) to cause the shaft and components connected thereto to move axially along the principal axis in forward and rearward directions relative to the housing, or 3) to cause the shaft and components connected thereto to execute a combination of turning and axial movements for such purposes as moving a latching element into and out of an orientation where the latching element aligns with a strike, and/or to press a strike-aligned latching element into engagement with the strike to securely releasably retain a closure in its closed position.

Commercially available handle and housing assemblies have a wide range of uses. Many are purchased by manufacturers of vehicle cabinetry, industrial cabinets, toolboxes and the like for use in products having mechanical and/or electrical devices such as latches that can be operated by moving a handle relative to an associated housing. Some handle and housing assemblies have housings that define forwardly facing recesses and employ handles that can retract to nest within the recesses. When the nestable handle of many of these handle and housing assemblies is moved to an extended position projecting forwardly from an associated housing-defined recess, the handle can be grasped and turned about a forwardly-rearwardly extending principal axis of the housing to turn and/or axially move a handle-connected shaft that extends through the housing along the principal axis.

Many commercially available handle and housing assemblies are lockable, either by inserting and turning a key in a housing-carried lock, or by attaching a padlock to the assembly to prevent relative movement of selected components of the assembly. It is unusual for handle and housing assemblies to be lockable not only by a housing carried lock, but also by a separately installed padlock.

The handle connected shafts of some handle and housing assemblies are used to move a latch element into and out of a latched position wherein the latch element engages a strike or other structure to retain an associated closure in a closed position. Latch element movements effected by handle movements may include turning of the latch element about the shaft axis, or translating the latch element along the shaft axis, or a combination of both of these types of movement.

The handle connected shafts of other handle and housing assemblies are used to turn a so-called "latch operating element" between non-operated and operated positions to cause one or more links that are connected to the latch operating element to operate one or more remotely located latches. Rigid links such as rods may be pushed or pulled by the latch operating element to cause one or more remotely located latches to operate. Flexible links such as cables may be pulled by the latch operating element to cause one or more remotely located latches to operate.

In some applications, it may be desirable to utilize rigid links that are positioned by handle and housing assemblies to move link-carried roller assemblies into and out of engagement with strike formations or other structure instead of utilizing rigid or flexible links to operate latches that hold closures in closed positions. In provisional application Ser. No. 60/610,385 filed Sep. 16, 2004 by Lee S. Weinerman et al and assigned to The Eastern Company, the disclosure of which is incorporated herein by reference, link-carried roller assemblies are disclosed that can be substituted for link-operated latches. The handle and housing assembly of the present invention is well suited for use with such link-carried roller assemblies. Therefore, when handle and housing assemblies embodying features of the present invention are described herein as being used to move links of various types, it will be understood that the links being moved by the handle and housing assemblies may be used not only to operate latch assemblies of a variety of types, but also (or in the alternative) to move link-carried roller assemblies into and out of latched positions in a manner disclosed in the aforementioned provisional application.

Patents assigned to The Eastern Company which disclose handle and housing assemblies having handles that are movable between retracted and extended positions, and that can be turned, while extended, to turn shafts of the assemblies, include U.S. Pat. No. 4,838,067 issued Jun. 13, 1989 to Weinerman et al, U.S. Pat. No. 4,838,054 issued Jun. 13, 1989 to Weinerman et al, and U.S. Pat. No. 4,706,478 issued Nov. 17, 1987 to Swan et al, the disclosures of which are incorporated herein by reference.

Some commercially available handle and housing assemblies utilize a handle that overlies at least part of a front portion of a key-operated lock. Patents assigned to The Eastern Company which disclose handle and housing assemblies having handles that overlie a key-operated lock when the handle is moved to a retracted or nested position include U.S. Pat. No. 4,912,951 issued Apr. 3, 1990 to Weinerman et al, and the aforementioned U.S. Pat. No. 4,706,478.

A patent assigned to The Eastern Company which discloses a handle and housing assembly that not only turns a shaft-connected latch element between latched and unlatched positions but also turns a shaft-connected latch operating element to move links to release a pair of remotely located latches is U.S. Pat. No. 4,641,865 issued Feb. 10, 1987 to Pastva, the disclosure of which is incorporated herein by reference.

Other patents assigned to The Eastern Company that disclose a variety of types of handle and housing assemblies used to operate pairs of links to release remotely located latches include U.S. Pat. No. 6,513,353 issued Feb. 4, 2003 to Weinerman et al, U.S. Pat. No. 6,490,895 issued Dec. 10, 2002 to Weinerman et al, U.S. Pat. No. 5,595,076 issued Jan. 21, 1997 to Weinerman et al, U.S. Pat. No. 4,892,338 issued Jan. 9, 1990 to Weinerman et al, U.S. Pat. No. 3,333,878 issued Aug. 1, 1961 to Pelcin, U.S. Pat. No. 2,735,706 issued Feb. 21, 1956 to Pelcin, and U.S. Pat. No. 2,729,089 issued Jan. 3, 1956 to Pelcin, the disclosures of which are incorporated herein by reference.

The referenced Parent Patent discloses handle and housing assemblies that each have a front side and a rear side, and that each have a handle that is connected to a shaft on the front side of the housing—a shaft that extends through the housing and can be turned and/or translated by the handle about and/or along a forwardly-rearwardly extending axis, referred to as a "principal axis." Features of the invention disclosed in the Parent Patent include "front features" and "rear features." Some embodiments of the Parent Patent invention incorporate only front features; some incorporate only rear features; and, some incorporate combinations of front and rear features. The present invention may utilize some of the front and/or some of the rear features of the invention disclosed in the referenced Parent Patent.

Just as handle and housing assemblies that embody features of the Parent Patent invention can be utilized to turn and/or to axially move shaft-carried components such as latch elements, latch operating elements or combinations thereof, so may handle and housing assemblies that embody features of the present invention. Thus, in some embodiments of the present invention, the shaft carries a latch element that is moved between latched and unlatched positions in response to handle movement of the shaft; whereas, in other embodiments, the shaft-carried latch element may be replaced by or supplemented by a latch operating element that connects with one or more links (which may be rigid or flexible, as described above) that, when moved by the latch operating element in response to handle movement of the shaft, causes one or more remotely located latches to operate, typically by releasing their engagement with associated strike or cabinet formations to permit a closure (on which the handle and housing assembly may be mounted) to open.

SUMMARY OF THE INVENTION

The present invention relates to handle and housing assemblies that each include a housing having a front side and a rear side, and that each have a handle that is connected to a shaft on the front side of the housing—a shaft that extends through the housing and can be turned by the handle about a forwardly-rearwardly extending axis, referred to as a "principal axis." Features of the invention include what will be referred to as "front features" and "rear features." Some embodiments of the invention incorporate only front features; some incorporate only rear features; and some advantageously incorporate combinations of both.

In some embodiments that employ "front features" of the invention, the housing defines a forwardly-facing recess configured to nest the handle when the handle is in a retracted position. In some embodiments, the retracted handle overlies a front portion of a housing-carried key-operated lock in a manner that conceals the lock's keyway from view.

In some embodiments, a stem portion of the handle and a forwardly-extending projection carried by the housing cooperate to define formations that can be padlocked together to retain the handle in its retracted or nested position. In some of these embodiments, the handle has a relatively narrow stem which defines a passage that opens rearwardly (when the handle is retracted) to receive the forwardly-extending projection therein, and aligned holes are formed through the stem and through the projection to receive the hasp of a padlock therein to retain the handle in its retracted position.

In padlockable embodiments of the invention, a padlock that retains the handle in a nested or retracted position may substitute for or supplement the action of a housing-carried key-operated lock having a lock bolt on the rear of the housing that is movable between locked and unlocked positions to selectively permit and prevent turning of the shaft about the principal axis. If a padlock is used to retain the handle in its nested or retracted position (i.e., to prevent movement of the handle from the retracted or nested position to the extended position), the housing-carried lock may perform a secondary locking function, namely to selectively permit turning of the shaft by the extended handle only when the lock bolt has been moved to its unlocked position. If only a padlock is used to lock the handle and housing assembly (i.e., if no housing-carried key-operated lock is provided to separately permit and prevent turning of the shaft about the principal axis), a padlock installed on the retracted handle can serve both to prevent movement of the handle to the extended position, and to prevent turning of the shaft about the principal axis. Thus, a padlock and a housing-carried lock may be used in concert to essentially "double lock" the handle and housing assembly, or either may be used separately to selectively lock various elements of the assembly in selected positions.

In some embodiments that employ "front features" of the invention, the handle pivots as it moves between extended and retracted positions. In some embodiments, a pivotal type of handle-to-shaft connection employs elements (such as cam surface formations on the handle that engage a housing-carried engagement surface that may be defined by a washer which encircles the shaft at a location just in front of a rear wall of the housing) that cooperate to cause forward and rearward movement of the shaft (and components connected to the shaft) along the principal axis in response to pivoting of the handle between its extended and retracted positions. And, in some of these cam-equipped embodiments, which typically also utilize a biasing element such as a shaft-surrounding spring to bias the shaft rearwardly, the forward-rearward movements of the handle may be utilized to move a latch element carried on a rear portion of the shaft into and out of a latched position wherein the latch element engages other structure to clamp closed a closure on which the handle and housing assembly may be mounted.

In some embodiments that employ "rear features" of the invention, components such as a control member, a latch element and/or a latch operating element are connected to a rear portion of the handle-turnable shaft, and turn with the handle and the shaft between first and second orientations. When in one or both of these orientations, one of the shaft-carried components such as a control member may engage one or a pair of spaced rearwardly projecting housing-carried formations to effectively limit the permitted range of turning movement about the principal axis of the handle, the shaft and such components as may be connected to a rear portion of the shaft.

In some embodiments that employ "rear features" of the invention, a control member connected to a rear portion of the handle-turnable shaft has a formation (such as a square hole that extends centrally through the control member that is sized to engage a rear shaft portion of square cross-section in a slip fit) that enables the control member to be installed on the shaft at different orientations. For example, in one orientation, one selected pair of opposed side surfaces of the square hole may engage one of two pairs of opposed side surfaces of the shaft's square cross-section, whereas, in another orientation, the same selected pair of opposed side surfaces of the square hole may engage the other of the two pairs of opposed side surfaces of the shaft's square cross-section. When the shaft and control member are provided with interfittable formations that may engage when the control member is installed on the shaft in at least two different orientations, it becomes possible for the control member and the shaft to be connected in alternate ways that enable the control member to be turned clockwise or counter-clockwise about the principal axis to a desired orientation as the handle is turned toward and away from a position wherein the handle can retract to nest within a forwardly-facing recess defined by the housing.

In some embodiments that employ "rear features" of the invention, rearwardly projecting formations of the housing are utilized to form either a pair of spaced-apart "stop formations" that are engaged by a shaft-carried element such as a control member when the shaft-carried element is in one or the other of the opposite ends of its permitted range of turning movement about the principal axis, or to form spaced-apart guide formations that engage opposite sides of a lock bolt to guide movements of the lock bolt along a path of travel between its locked and unlocked positions. In some embodiments, the rearwardly projecting formations are configured to serve both of these very different functions.

BRIEF DESCRIPTION OF THE DRAWINGS

These and other features, and a fuller understanding of the invention will be better gained from the description and claims that follow, taken together with the accompanying drawings, wherein:

DETAILED DESCRIPTION

As has been explained above, the present invention includes both "front features" and "rear features" that can be put to use separately; however, in preferred practice, front and rear features of the invention are advantageously combined.

Figure 1:
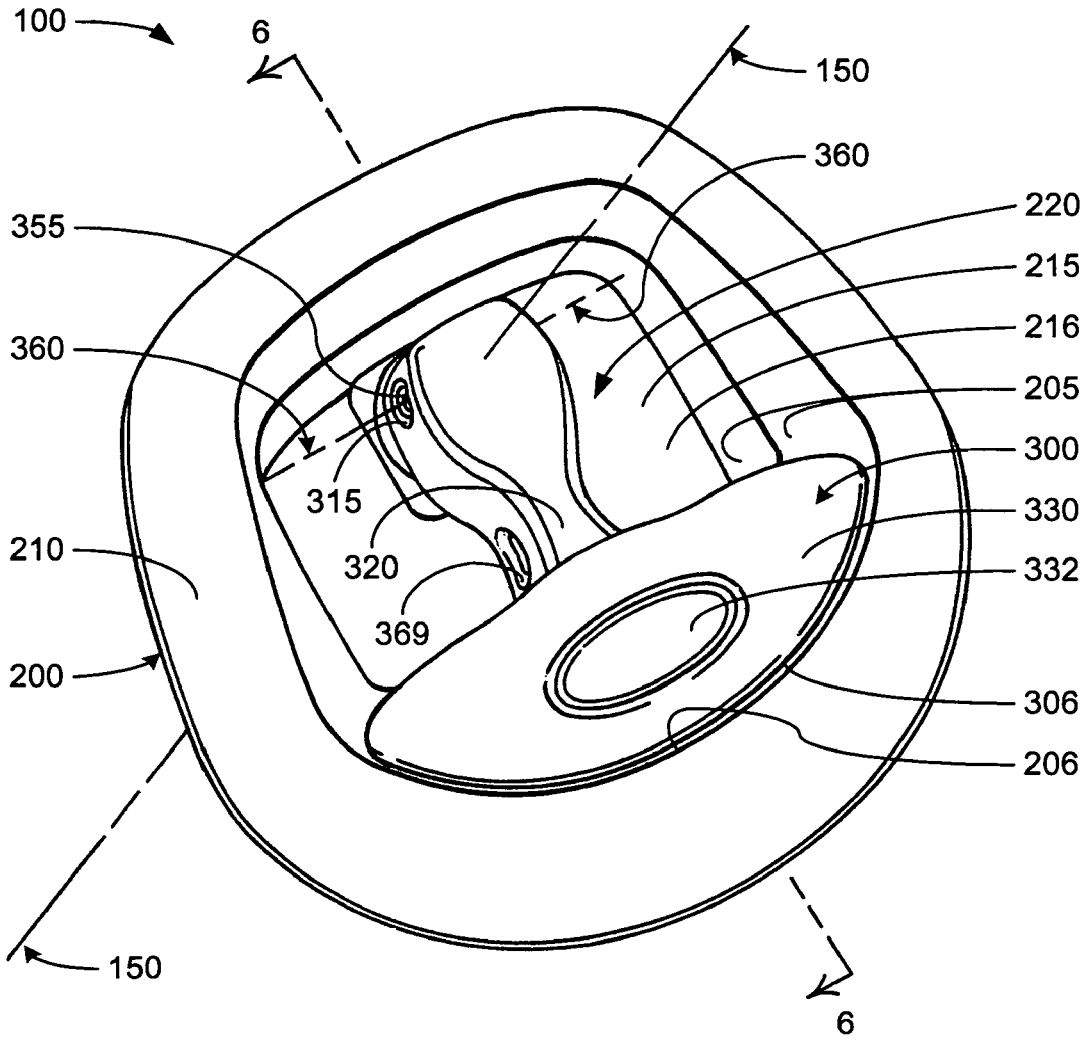
FIG. 1 is a perspective view showing front portions of a handle and housing assembly with the handle retracted to nest within a forwardly facing recess of the housing.
Figure 2:
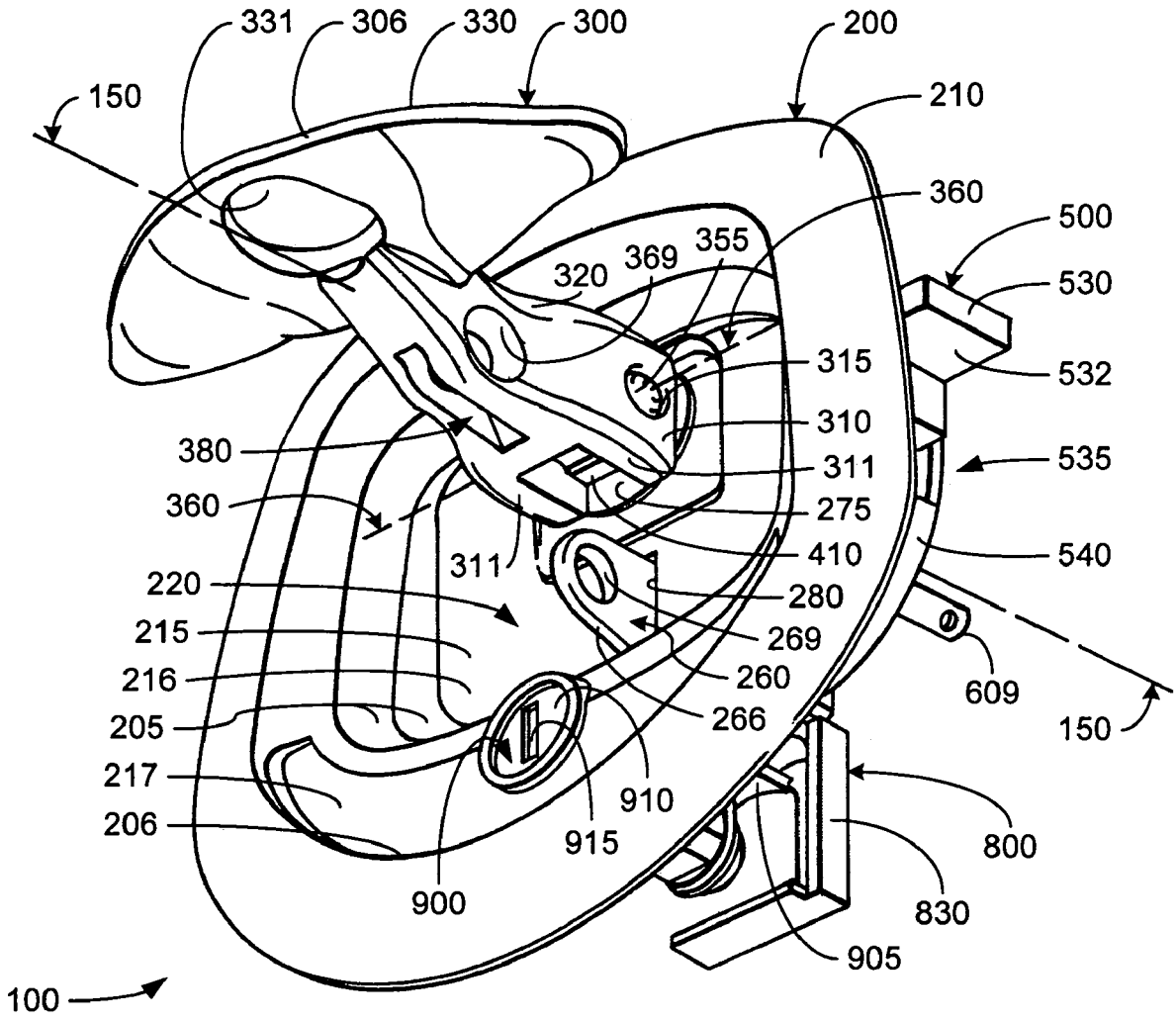
FIG. 2 is a perspective view showing mainly front portions of the handle and housing assembly, with the handle extended to project forwardly from the housing.
Figure 3:
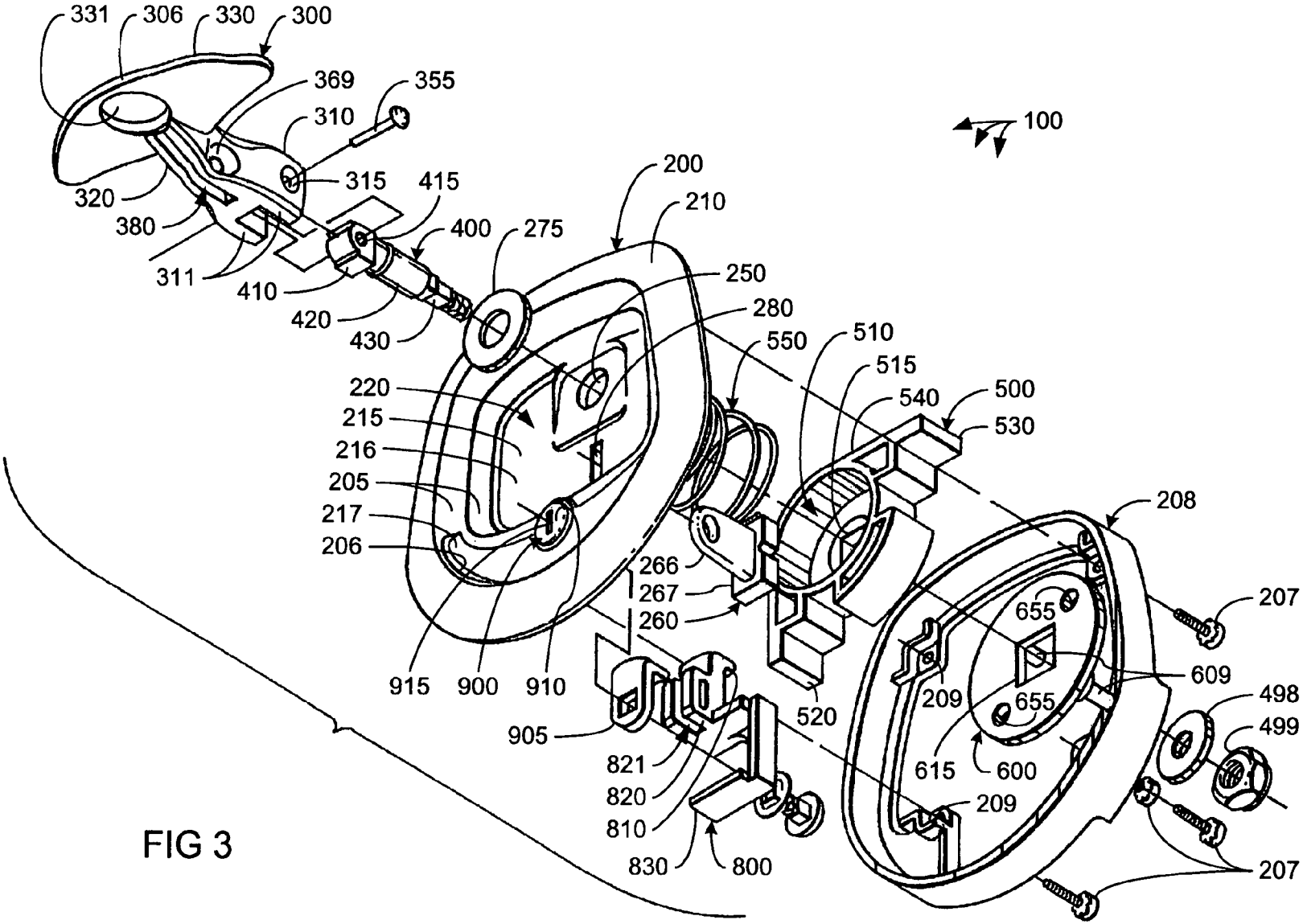
FIG. 3 is an exploded perspective view showing components of the handle and housing assembly together with a mounting bracket for use therewith.

Referring to FIGS. 1-3, a handle and housing assembly embodying both "front features" and "rear features" of the invention is indicated generally by the numeral 100. The assembly 100 includes a housing 200 that defines a forwardly facing recess 220, and a handle 300 that can nest within the recess 220. A shaft 400 extends rearwardly from the handle 300 through the housing along a forwardly-rearwardly extending axis 150 that is referred to herein as the "principal axis."

In preferred practice, the housing 200 is formed as a one-piece member from metal or plastic. A mounting flange 210 of the housing 200 surrounds the forwardly facing recess 220. A side wall 205 extends about the perimeter of the recess 220 and connects the mounting flange 210 to a stepped back wall 215 located at the rear of the recess 220. A rearmost portion 216 of the back wall 215 closes the deepest portion of the recess 220, and a forwardly stepped portion 217 of the back wall 215 closes a more shallow end region of the recess 220.

The shallow end region of the recess 220 is bounded by a concavely curved portion 206 of the side wall 205 that faces toward the principal axis 150. The handle 300 is of generally T-shape, having a relatively narrow stem portion 320 that joins smoothly with a relatively wide crossbar portion 330 which has a convexly curved end region 306 that extends closely alongside the concavely curved portion 206 of the housing's side wall 205 when the handle 300 is in the nested position of FIG. 1. Other features of the handle 300 will be described shortly.

Figure 4:
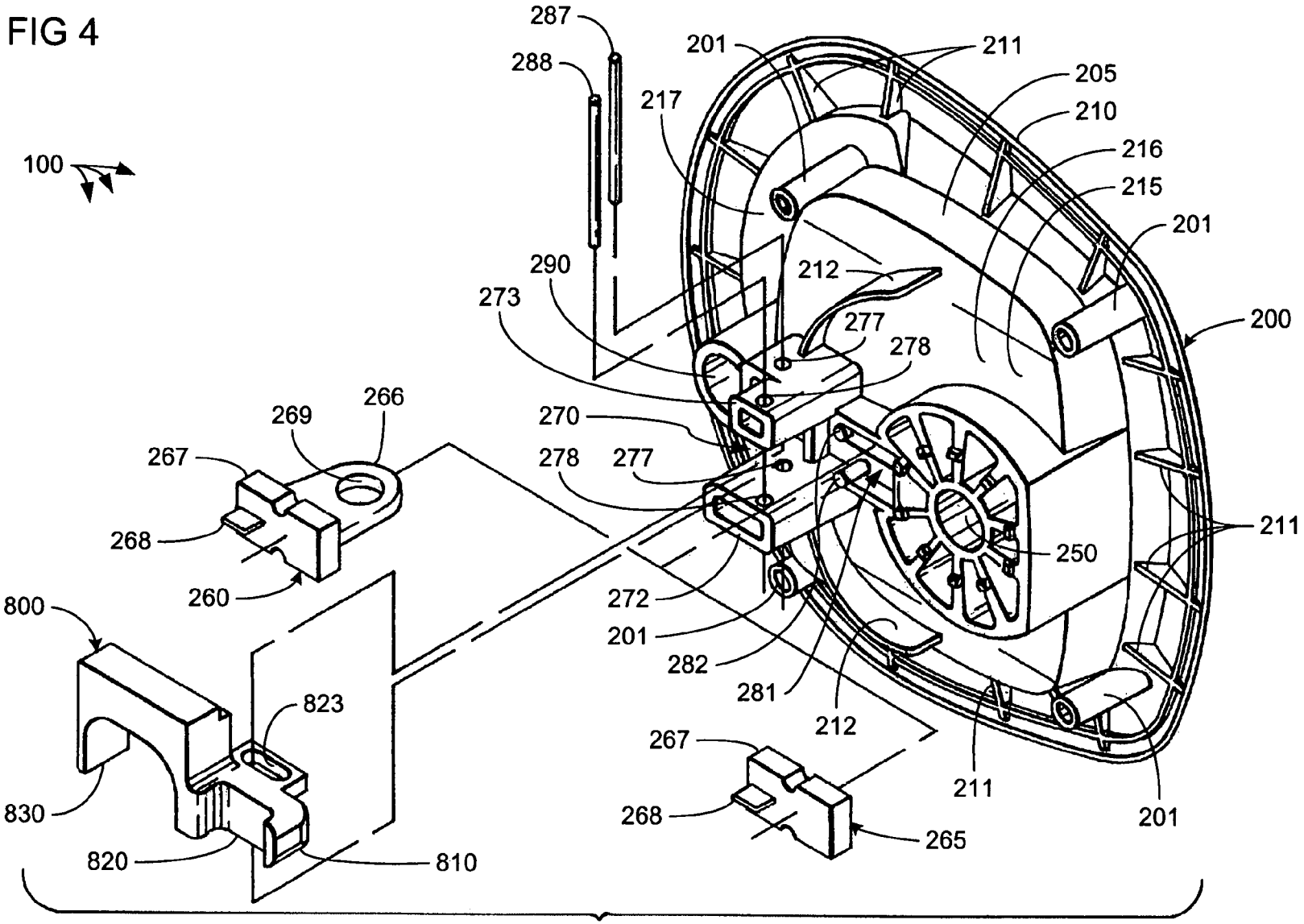
FIG. 4 is an exploded perspective view showing mainly rear portions of the housing and selected rear components of the assembly, including an alternative form of insert member.
Figure 5:
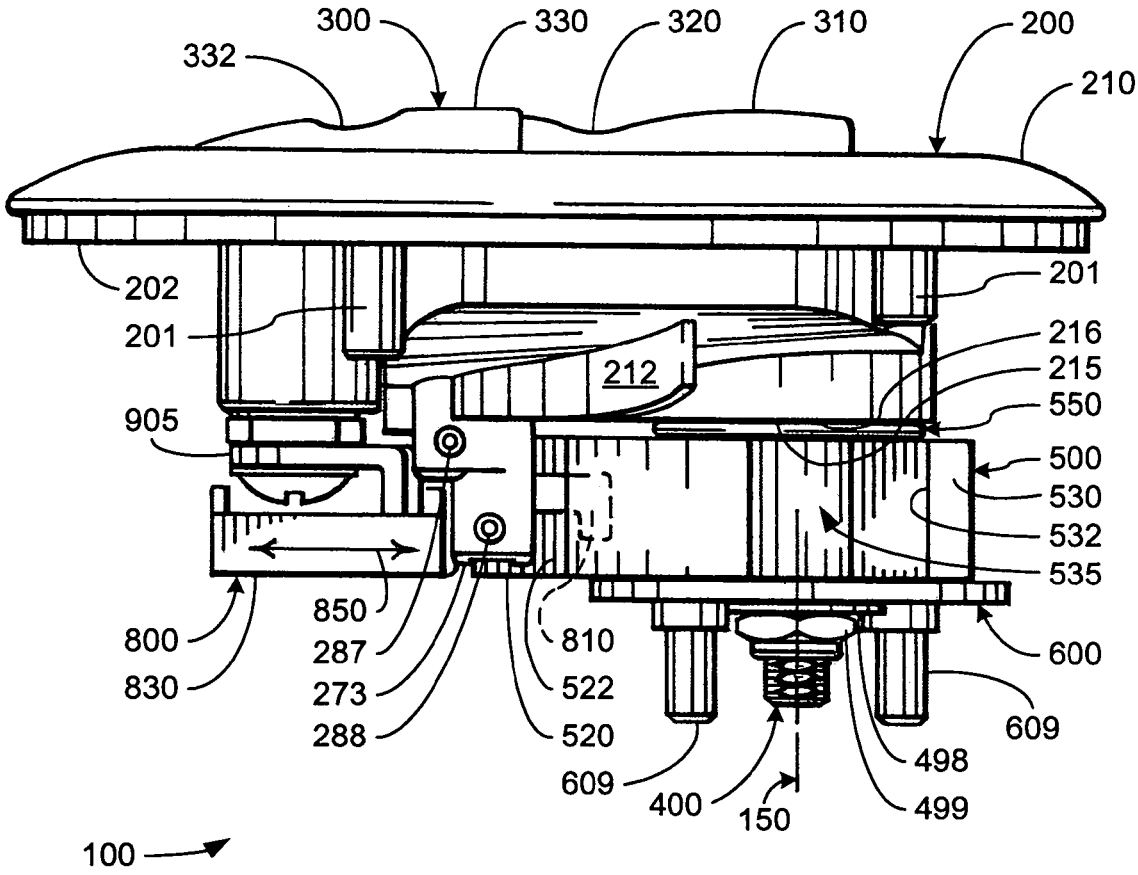
FIG. 5 is a side view of the assembly with the handle retracted and with a lock bolt of the assembly in its locked position.

Referring to FIGS. 3 and 4, the housing 200 defines a forwardly-rearwardly extending passage 250 that encircles the principal axis 150 and opens through the rearmost portion 216 of the back wall 215 into the deepest portion of the recess 220. The shaft 400 extends through the passage 250, as is best seen in the sectional depictions of FIGS. 6-8 and 15. Referring to FIG. 3, the rearmost portion 216 of the back wall 215 also is provided with a slot-like opening or slot 280.

In preferred practice, the handle 300 can be padlocked to the housing 200 to retain the handle 300 in the retracted position of FIG. 1; however, this padlockable feature can be eliminated if desired, as will be explained shortly.

If the handle 300 is to be "padlockable" to retain it in the retracted position depicted in FIG. 1, cooperating formations are carried by the handle 300 and by the housing 200 that permit a conventional padlock of medium size (such as the padlock indicated by the numeral 99 in FIG. 9) to be installed on the front side of the housing 200 to lock the retracted handle 300 to the housing 200. In a padlockable embodiment of the assembly 100, the slot-like opening or slot 280 formed through the back wall 215 of the housing 200 receives a forwardly extending formation 266 (see FIG. 2) of an insert member 260 (best illustrated in FIGS. 3 and 4). The formation 266 extends forwardly from the rear side of the housing 200 through the slot 280 and into the forwardly-facing housing-defined recess 220 where the handle 300 nests when in its retracted position.

In a padlockable embodiment of the assembly 100, holes 369, 269 are formed through the stem portion 320 of the handle 300 and through the forwardly extending formation 266, respectively. The holes 269, 369 are configured to align when the handle 300 is in the retracted position of FIG. 1. When the holes 269, 369 align as the result of the handle 300 being moved to the retracted position depicted in FIG. 1, a hasp of a medium sized padlock (such as the hasp 98 of a padlock 99 shown in FIG. 9) can be inserted through the aligned holes 269, 369 to lock the handle 300 in its retracted position—a topic that will be addressed in greater detail shortly. Because the insert member 260 is connected to and carried by the housing 200 (in a manner that will be explained shortly), the forwardly extending formation 266 of the insert member 260 can be said to provide a "housing connected formation" that extends forwardly within the forwardly facing recess 220 of the housing 200 for being padlocked to the handle 300 when the handle 300 is in its retracted position.

If the handle 300 is not to be padlockable when in its retracted position, neither the forwardly extending formation 266 nor the holes 369, 269 need be provided; and, instead of using the insert member 260 as depicted in FIG. 4, a substantially identically configured alternate form of insert member 265 (also shown in FIG. 4) preferably is used to plug or block the slot-like opening or slot 280. The alternate insert member 265 has a configuration identical to the insert member 260 except that the alternate insert member 265 has no forwardly extending formation that corresponds to the forwardly extending formation 266 of the insert member 260.

Returning to a discussion of features of the housing 200 and referring principally to FIGS. 3 and 4, a forwardly-rearwardly extending passage 290 is formed through the forwardly stepped portion 217 of the back wall 215. The passage 290 substantially parallels the passage 250 at a location spaced therefrom, and opens into the shallow end region of the recess 220. If the assembly 100 is to include a housing-carried key-operated lock for preventing the shaft 400 from being turned about the principal axis 150, then a key-operated lock mechanism 900 is installed in the passage 290; otherwise, either the passage 290 is omitted when the housing 200 is formed, or the passage 290 is fitted with a suitable plug (not shown).

The lock assembly 900 has a relatively large diameter front portion 910 through which a centrally located keyway 915 opens into the shallow end region of the recess 220. When the handle 300 is in the retracted position of FIG. 1, the crossbar portion 330 of the handle 300 overlies and conceals from view the front portion 910 of the key operated lock mechanism 900. When the handle 300 is in the retracted position of FIG. 1, the crossbar portion 330 so closely overlies the keyway 915 of the lock mechanism 900 as to prevent a key from being inserted into the keyway 915. For a key to be inserted into the keyway 915, the handle 300 must be pivoted out of the retracted position of FIG. 1 toward the extended position depicted in FIG. 2.

Turning now to a discussion of features of the back side of the housing 200 and referring initially to FIG. 4, reinforcing ribs 211, 212 are provided on rearwardly facing portions of the mounting flange 210 and on the rearmost portion 216 of the back wall 215 to rigidify the housing 200. Four mounting posts 201 are provided adjacent four corner regions of the rearmost portion 216 of the back wall 215 and have interiors that open rearwardly to receive threaded fasteners 207 (shown in FIG. 3). Referring to FIG. 3, the threaded fasteners 207 extend through holes 209 formed through rear portions of a mounting bracket 208 that preferably is supplied with the assembly 100 for use in mounting the assembly on a relatively thin closure (not shown).

Usually, the type of closure on which the assembly is mounted is formed from a relatively thin sheet of metal (not shown), and is provided with a mounting opening (not shown) that is configured to permit rear portions of the housing 200 to extend therethrough. In a typical installation of the assembly 100 on such a closure, rear surfaces of the mounting flange 210 of the housing 200 are covered by a resilient gasket, which is indicated by the numeral 202 in FIGS. 5-8 and 15. The gasket 202 has an open central portion through which central portions of the housing 200 extend, and has a perimeter that corresponds closely in size and shape to the perimeter of the mounting flange 210. Rear surface portions of the mounting flange 210 press the gasket 202 into engagement with front surface portions of the closure in locations extending about the mounting opening of the closure at the same time that front portions of the mounting bracket 208 are clamped by the fasteners 207 into engagement with rear surface portions of the closure as the fasteners 207 are threaded into and tightened in place within the rearwardly opening interiors of the mounting posts 201 of the housing 200.

Using a mounting bracket such as the mounting bracket 208, and using threaded fasteners such as the fasteners 207 to clamp a gasketed mounting flange such as the mounting flange 210 into engagement with portions of a closure extending about a mounting opening formed through the closure is a technique well known to those who are skilled in the art for mounting handle and housing assemblies on closures or other thin structures. This well known mounting technique is used with many of the handle and housing assemblies disclosed in the patents and pending patent applications identified earlier herein.

Referring to FIGS. 4, 12, 13 and 16, a pair of spaced apart, housing-carried, rearwardly projecting formations 272, 273 extend rearwardly from the housing 200. In preferred practice, the formations 272, 273 are integrally formed elements of the one-piece housing 200. A trough-like space 270 (see FIG. 4) is provided between the formations 272, 273—a space through which a lock bolt 800 moves along a path of travel 850 between an unlocked position shown in FIGS. 7, 8 and 13, and a locked position shown in FIGS. 5, 6, 12, 15 and 16. Referring to FIG. 4, aligned pairs of holes 277, 278 extend through the formations 272, 273 for receiving opposite end regions of a pair of roll pins 287, 288 that bridge the trough-like space 270 when their opposite end regions are received in the holes 277, 278.

In preferred practice, the formations 272, 273 serve two purposes. One purpose served by the formations 272, 273 is to assist the roll pins 287, 288 in engaging various surfaces of the lock bolt 800 to guide movements of the lock bolt 800 along the path of travel 850. In this role, the formations 272, 273 can be said to provide "guide formations" that receive the lock bolt 800 therebetween in a slip fit that facilitates smooth movement of the lock bolt 800 along the path of travel 850, guided by the engagement of the formations 272, 273 with opposite sides of the lock bolt 800.

Figure 6:
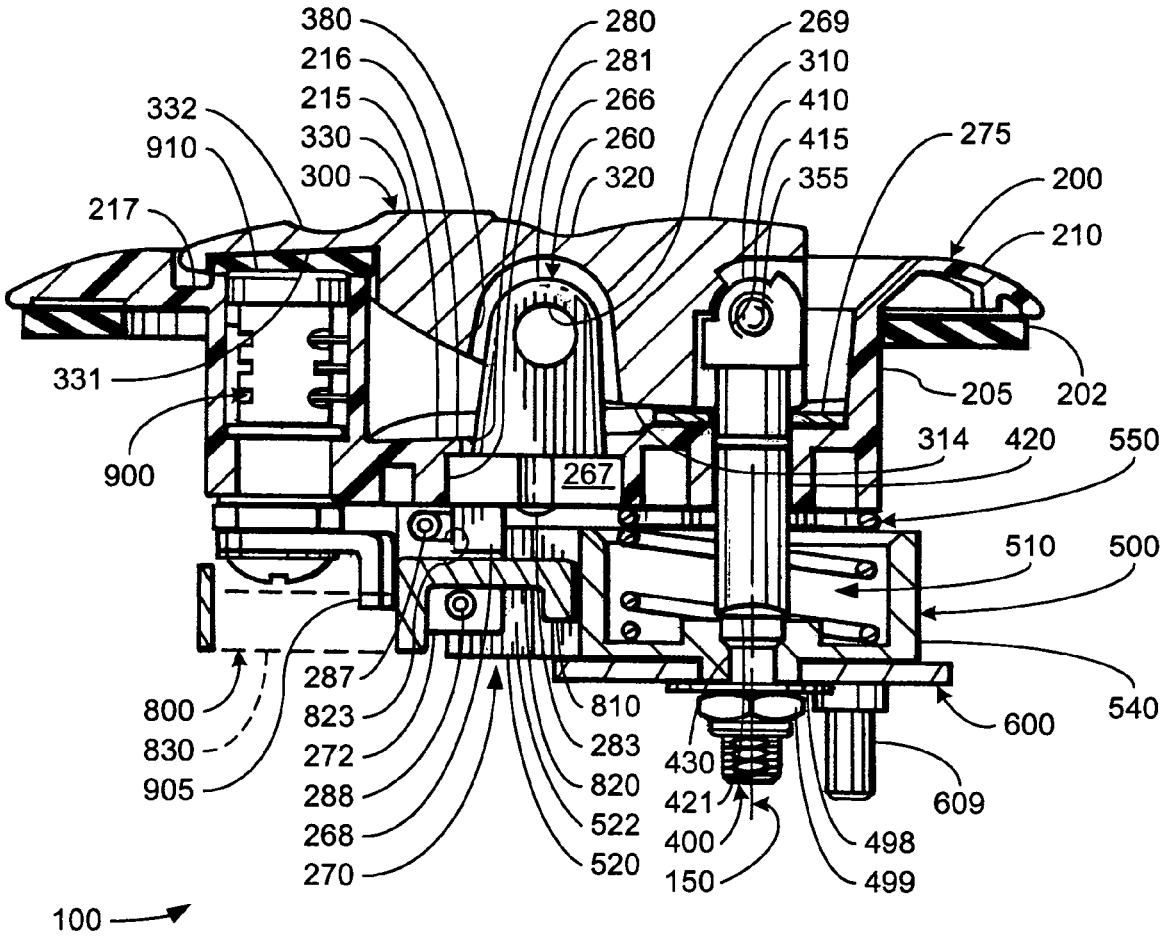
FIG. 6 is a sectional view substantially as seen from a plane indicated by a line 6-6 in FIG. 1, with the handle retracted and the lock bolt in its locked position.
Figure 7:
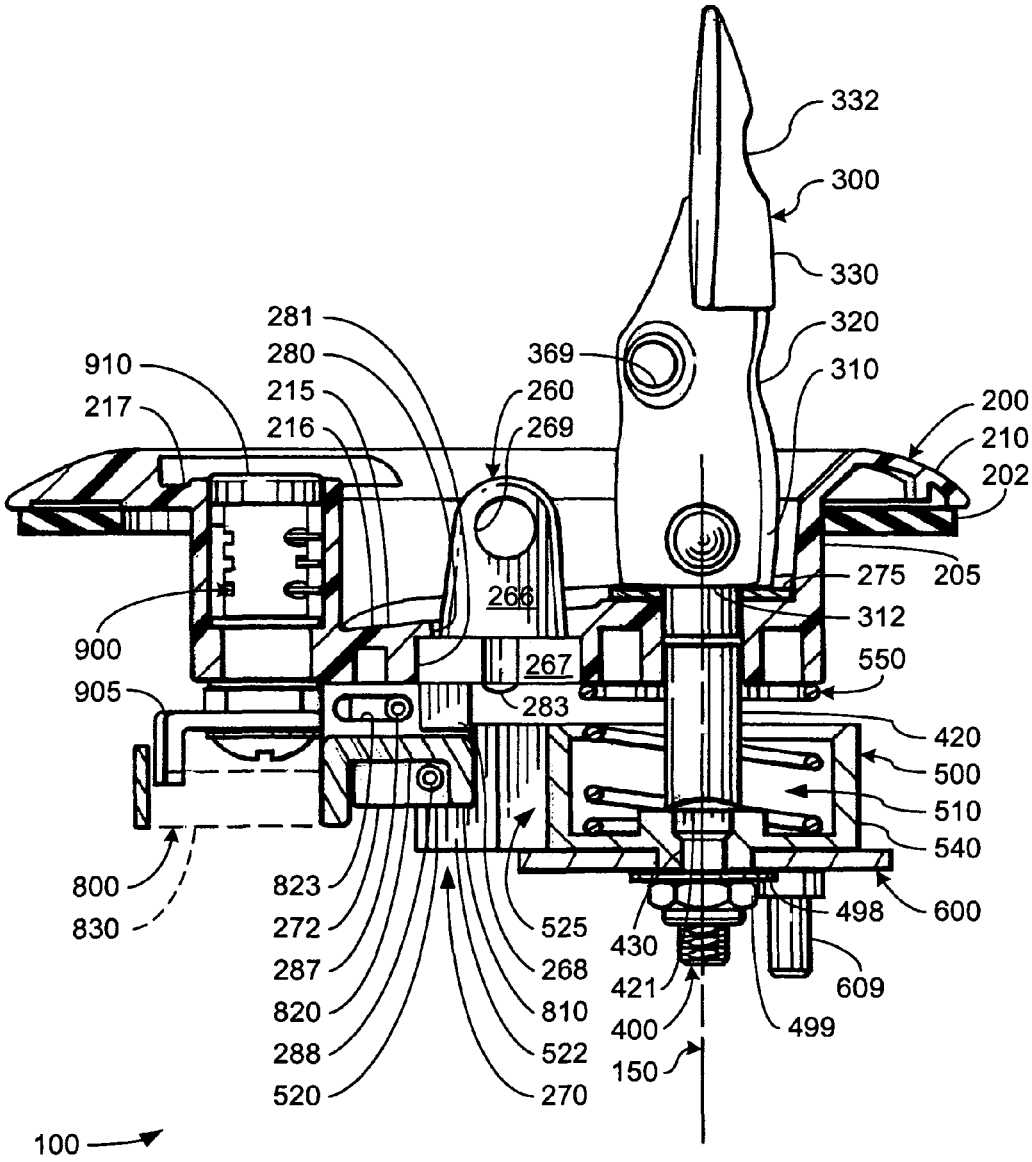
FIG. 7 is a sectional view similar to FIG. 6, but with the handle extended and with the lock bolt in its unlocked position.
Figure 8:
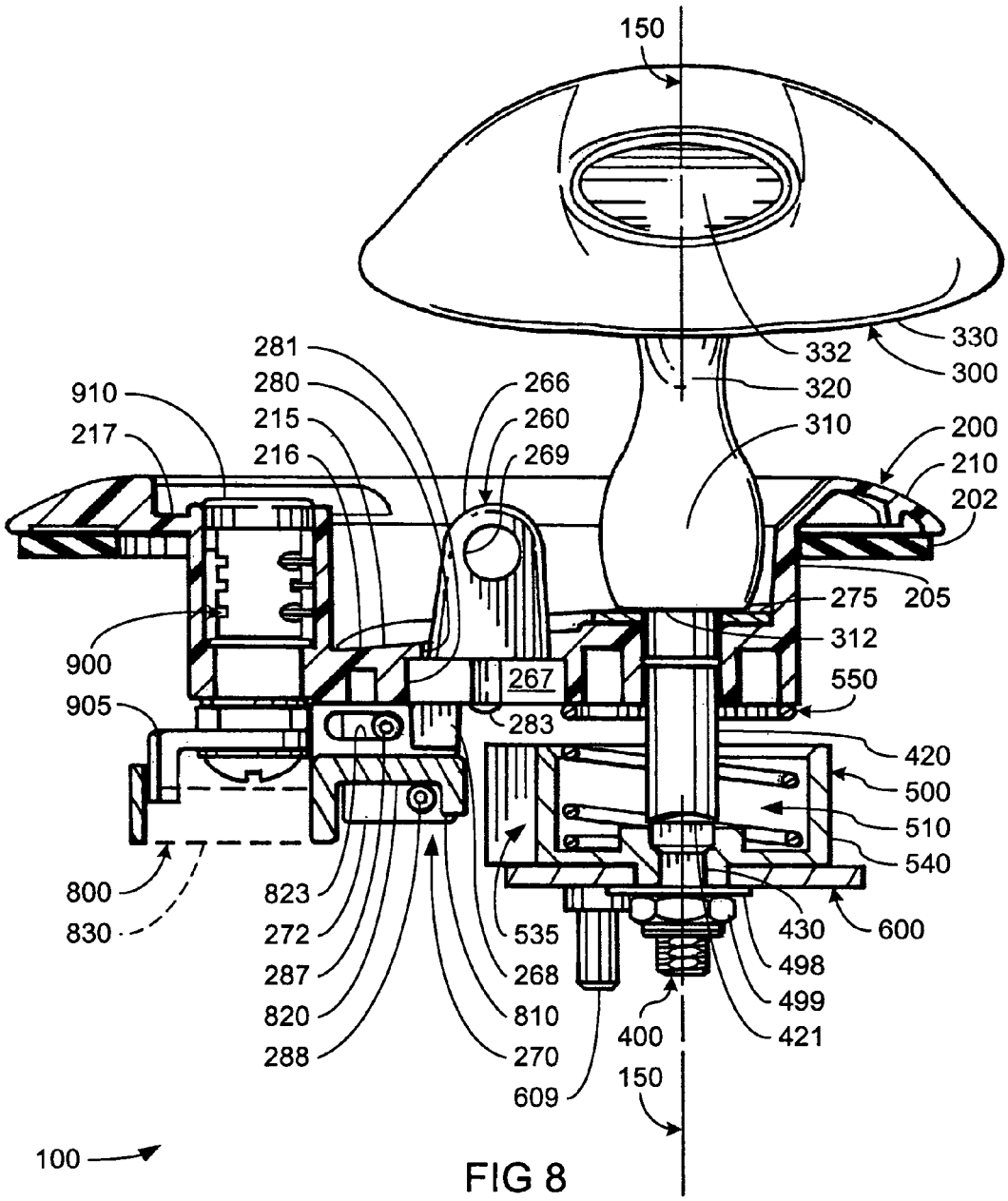
FIG. 8 is a sectional view similar to FIG. 7, but with the handle extended and turned a quarter turn, and with the lock bolt still in its unlocked position.
Figure 12:
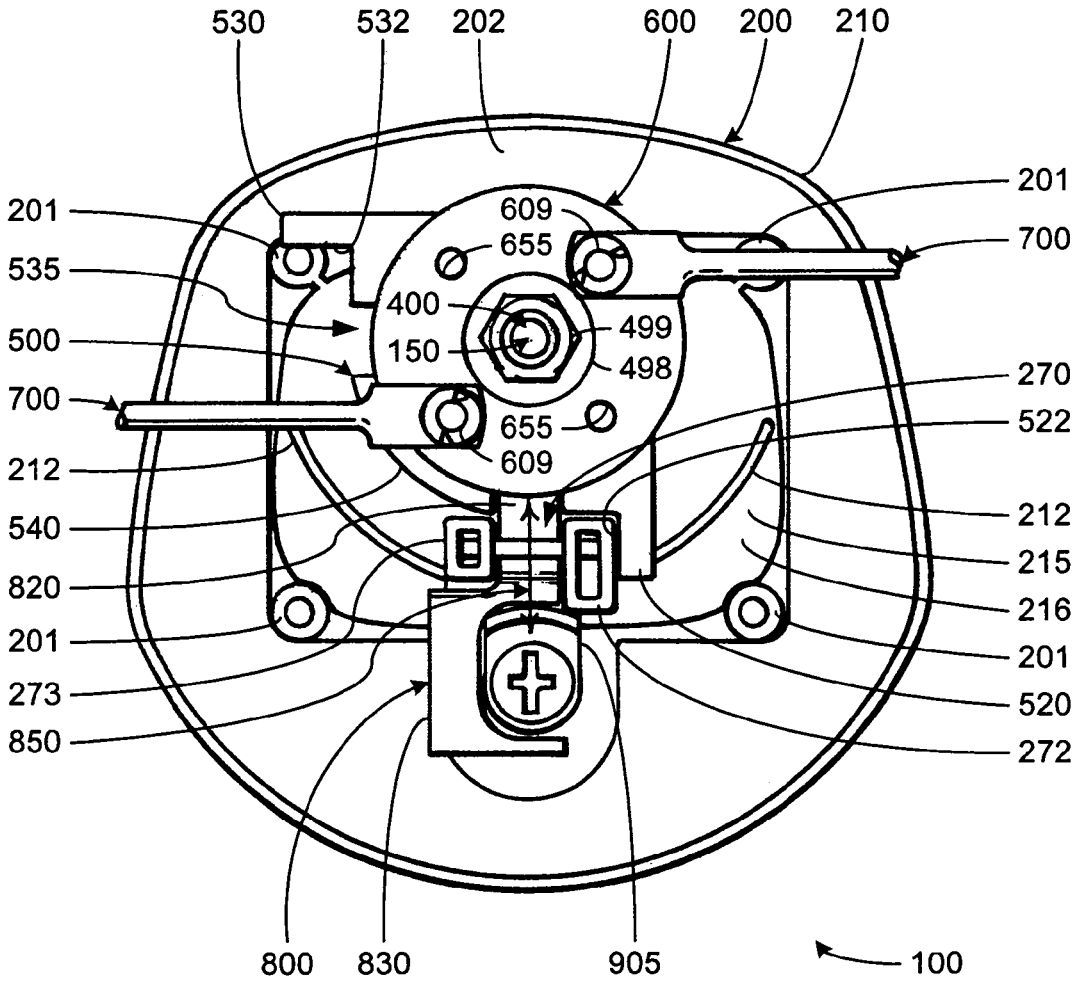
FIG. 12 is a rear view of the assembly with end regions of a pair of elongate latch operating links connected thereto, and with the lock bolt in its locked position.
Figure 13:
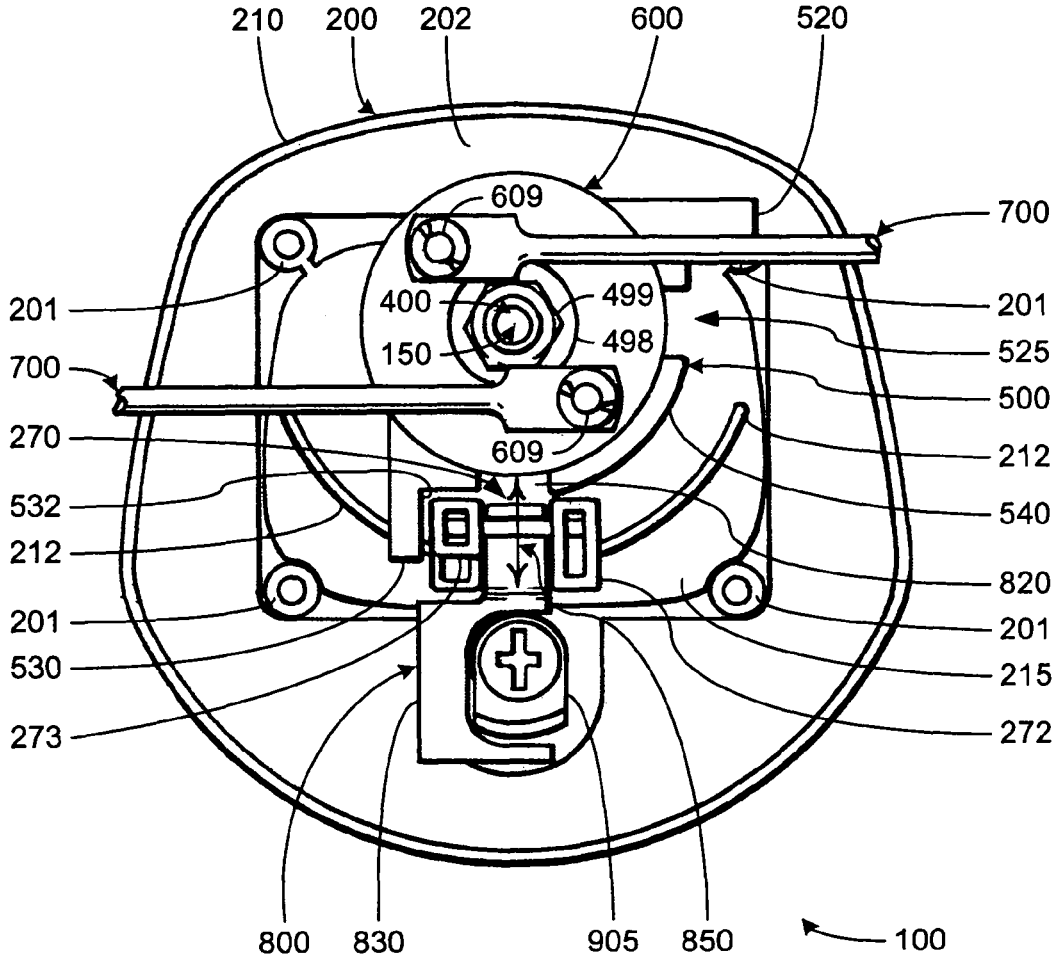
FIG. 13 is a rear view similar to FIG. 12 with the lock bolt still in its unlocked position, but with the link end regions moved from the positions depicted in FIG. 12.
Figure 16:
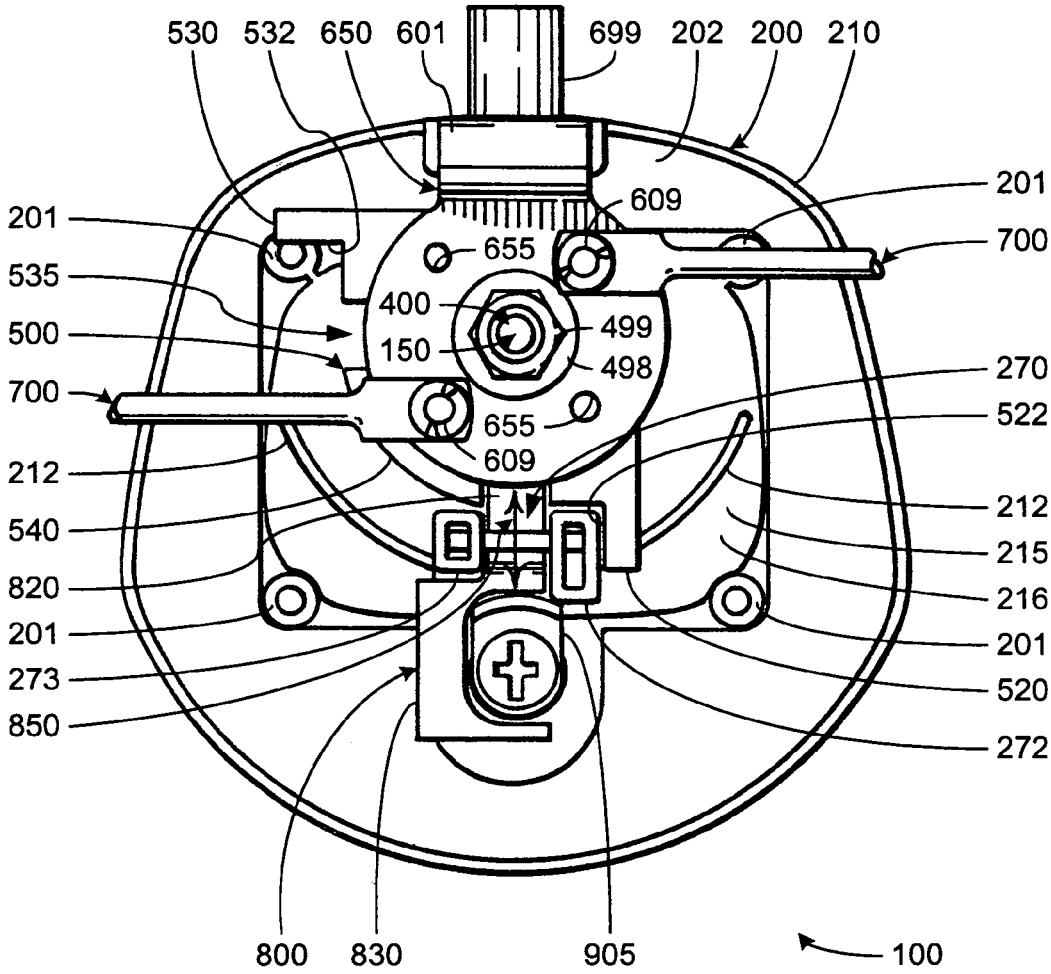

In another role, the rearwardly projecting formations 272, 273 serve as "stops" or "stop formations" that can be engaged by arms 520, 530 of a generally L-shaped control member 500 (see FIG. 3) which is mounted on a rear portion 430 of the shaft 400 (see FIGS. 6-8). The "stop" function of the formations 272, 273 enables the formations 272, 273 to limit the range of permitted turning movement of the handle 300, the shaft 400 and the control member 500 (and/or such other components as may be connected to the shaft 400 to turn therewith about the principal axis 150). More specifically, when the control member 500 is at one of two opposite ends of its permitted range of turning movement, as depicted in FIGS. 12 and 16, the stop surface 522 of the control member arm 520 engages the housing-carried formation 272 to prevent further clockwise turning of the control member 500, the shaft 400 and the handle 300; and, when the control member 500 is at the other end of its permitted range of turning movement about the principal axis 150, as depicted in FIG. 13, the stop surface 532 of the control member arm 530 engages the housing-carried formation 273 to prevent further counter-clockwise turning of the control member 500, the shaft 400 and the handle 300.

Continuing with a description of rear features of the housing 200 and referring still to FIG. 4, a rearwardly-opening recess 281 is defined by rear portions of the housing 200 at a location just behind the slot-like opening or slot 280 that opens through the rear wall 215 of the housing 200. The recess 281 has a generally rectangular shape that is bordered on opposite sides by a pair of rearwardly extending pin-like formations 282. The recess 281 is configured to receive the generally rectangular central portion 267 of one or the other of the insert members 260, 265—it being recalled that the insert member 260 is utilized when the handle 300 of the assembly 100 is to be padlockable when in the retracted position of FIG. 1, and that the alternate insert member 265 is substituted for the insert member 260 when handle 300 of the assembly 100 is not to be padlockable.

The generally rectangular central portion 267 (of whichever one of the insert members 260, 265 is installed in the recess 281) is retained in the recess 281 by riveting or crimping rear end regions of the pin-like formations 282 to provide enlarged head formations that overlie small areas of the rear surface of the central portion 267. One of these enlarged head formations is designated by the numeral 283 in FIGS. 6-8 and 15.

Referring still to FIG. 4, each of the insert members 260, 265 carries a tab-like projection 268 configured to extend rearwardly from the recess 281 into the trough-like space 270 to assist the formations 272, 273 and the roll pins 287, 288 in guiding movements of the lock bolt 800 along the path of travel 850. In FIGS. 6-8 and 15, it will be seen that the tab-like projection 268 is located closer to the principal axis 150 than is the roll pin 287. In FIG. 3 it will be seen that a longitudinal slot 821 (a slot that extends along the travel path 850) is defined by the lock bolt 800 at a location near where the roll pin 287 extends through another slot defined by the lock bolt 800, namely a transversely extending slot 823 (depicted more clearly in FIG. 4). In FIGS. 7 and 8, the manner in which the roll pin 287 extends through the slot 823 at a location near the tab-like projection 268 can best be seen.

In preferred practice, the handle 300 is formed as a one-piece member from metal. The relatively long, relatively thin stem portion 320 of the handle 300 extends from the relatively wide crossbar portion 330 of the handle 300 to a location where a yoke formation 310 of the handle 300 provides substantially identical spaced apart legs 311. The legs 311 are configured to receive a relatively large front portion 410 of the shaft 400 therebetween in a slip fit. A hole 415 is formed through the shaft's front portion 410, and aligned holes 315 are formed through the legs 311 of the yoke formation 310. When the shaft's front portion 410 is inserted between the yoke's legs 311 so that the holes 315, 415 align, a headed pivot pin 355 is inserted through the aligned holes 315, 415 and riveted in place to establish a handle-to-shaft connection 350 that permits the handle 300 to pivot relative to the shaft 400 about an axis 360 which extends transverse to the principal axis 150.

The narrow stem portion 320 and the wide cross-bar portion 330 of the handle 300 are ergonomically designed to be easy and comfortable to grasp for purposes of pivoting the handle 300 about the axis 360 between retracted and extended positions, and for turning the handle 300 about the principal axis 150 (when the handle 300 is extended as depicted in FIG. 2) to turn the shaft 400 and components connected to rear portions of the shaft 400. As is best seen in FIGS. 2 and 3, a thumb recess 332 is provided in the front side of the crossbar portion 330—a recess that opens forwardly when the handle 300 is in the retracted position of FIG. 1.

As is best seen in FIGS. 2 and 3, at a location on the opposite side of the crossbar portion 330 from the thumb recess 332 is a recess 331 that opens rearwardly (when the handle 300 is in the retracted position of FIG. 1) to receive within the recess 331 the front portion 910 of the lock mechanism 900. When the front portion 910 of the lock mechanism 900 extends into the recess 331, the keyway 915 is covered by the crossbar portion 330 of the handle 300. If a key (not shown) is inserted into the keyway 915 at a time when the handle is in the extended position of FIG. 2, the handle 300 cannot be pivoted about the axis 360 the full way from the extended position of FIG. 2 to the retracted position of FIG. 1 because the presence of the key in the keyway 915 will obstruct the complete retraction of the handle 300.

Figure 15:
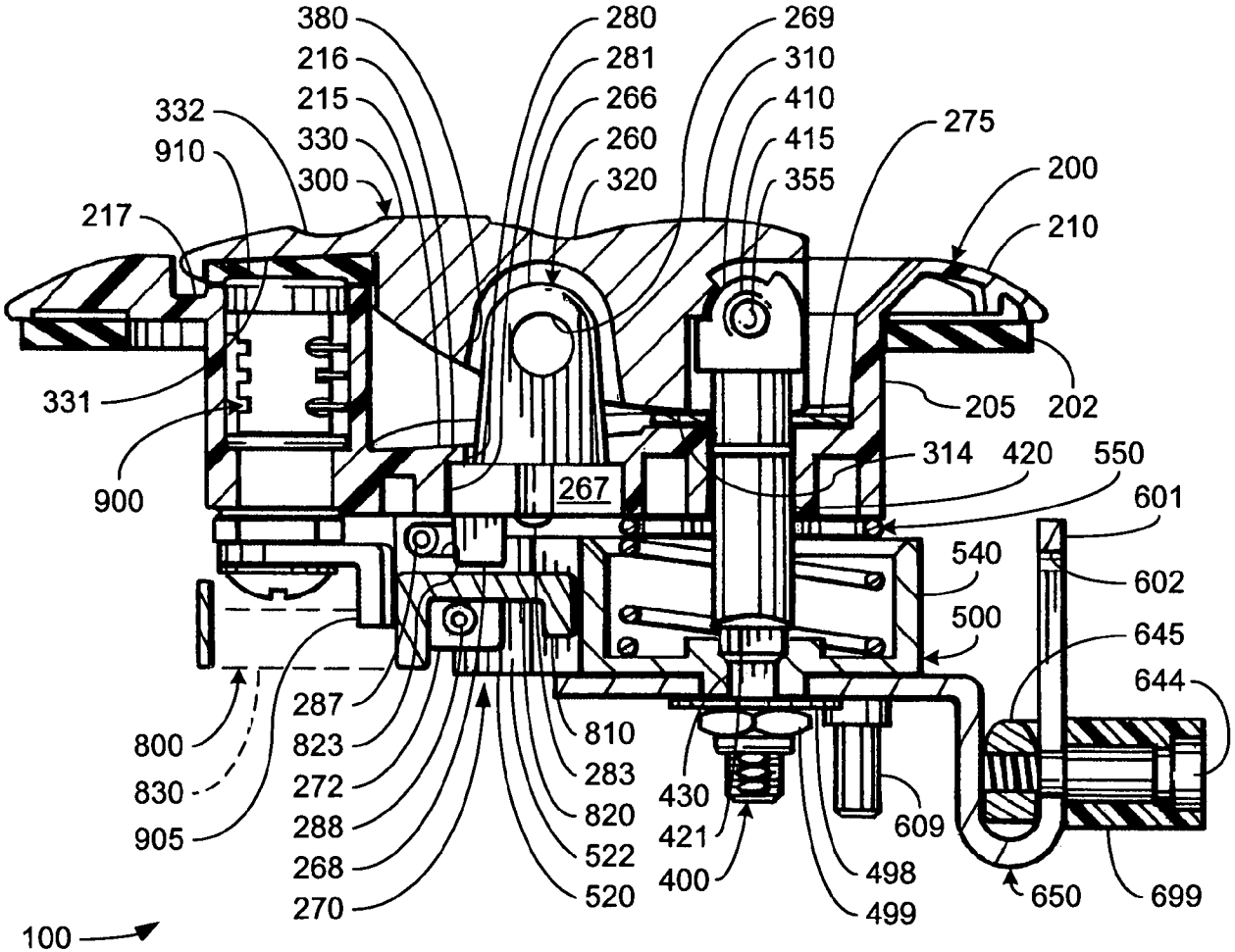
FIG. 15 is a sectional view similar to FIG. 6, but with the combination latch element and latch operating element substituted for the latch operating element shown in FIG. 6, and with portions of the combination latch element and latch operating element shown in cross-section; and, FIG. 16 is a rear view similar to FIG. 12, but with the combination latch element and latch operating element substituted for the latch operating element shown in FIG. 12.

Referring to FIGS. 2 and 3, an elongate slot 380 is formed in the stem portion 320 of the handle 300. The slot 380 provides a passage that opens rearwardly (but not forwardly) when the handle 300 is in the retracted position of FIG. 1. As is best seen in FIGS. 6 and 15, the passage or slot 380 is configured to loosely receive therein (when the handle 300 is retracted) the forwardly projecting portion 266 of the insert member 260. The aligned holes 369 communicate with the slot 380 as they extend through spaced-apart side regions of the narrow stem portion 320 of the handle 300.

When the handle 300 is in the retracted position of FIG. 1, the holes 369 in the stem portion 320 of the handle 300 align with the hole 269 formed through the forwardly projecting portion 266 of the insert member 260, as has been described previously, so the hasp of a padlock can be inserted through these aligned holes to lock the handle 300 in its retracted position. In essence, the forwardly projecting portion 266 of the insert member 260 provides a locking formation or locking member carried by the housing that can be engaged by a padlock to lock the handle 300 in its retracted position, nested in the forwardly facing housing-defined recess 220, as depicted in FIG. 1.

Figure 9:
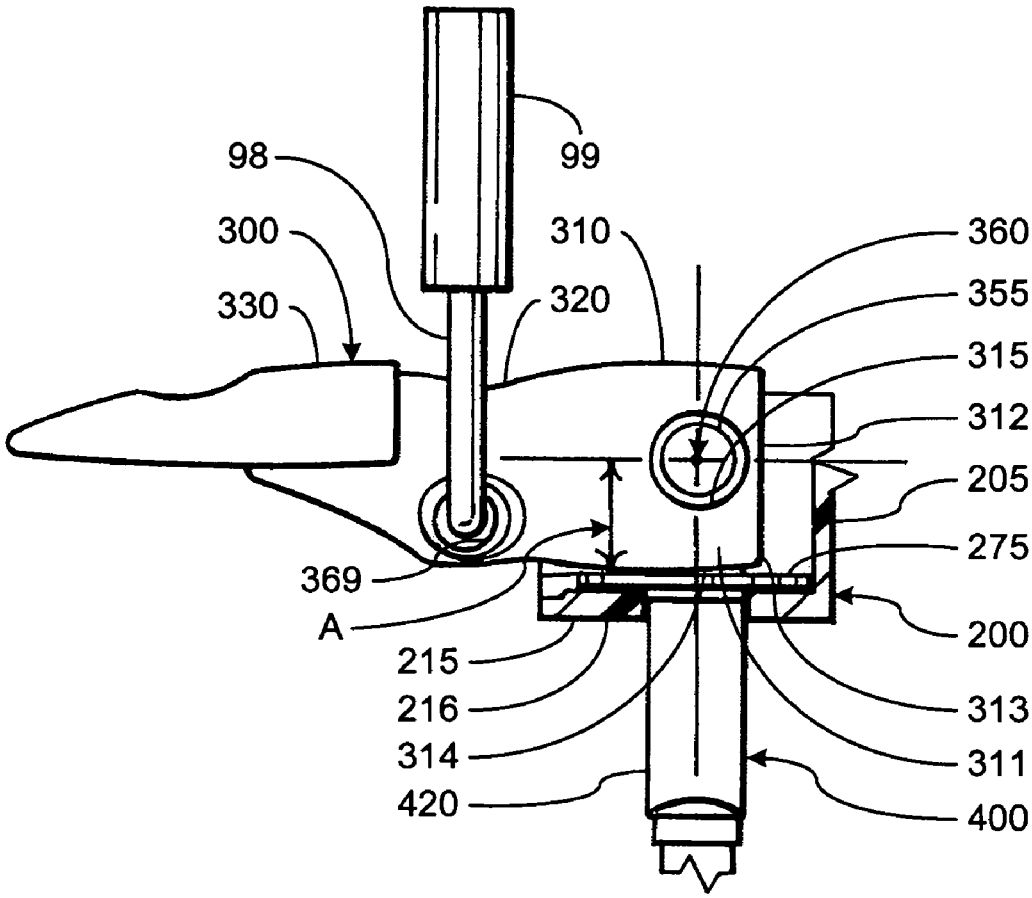
FIG. 9 is a side elevational view of the handle, a portion of the shaft, and components adjacent a pivotal connection of the handle and the shaft, with a portion of the housing shown in cross-section, with the handle in its retracted position, and with a padlock installed on a stem portion of the handle as can be done to retain the handle in its retracted position.
Figure 10:
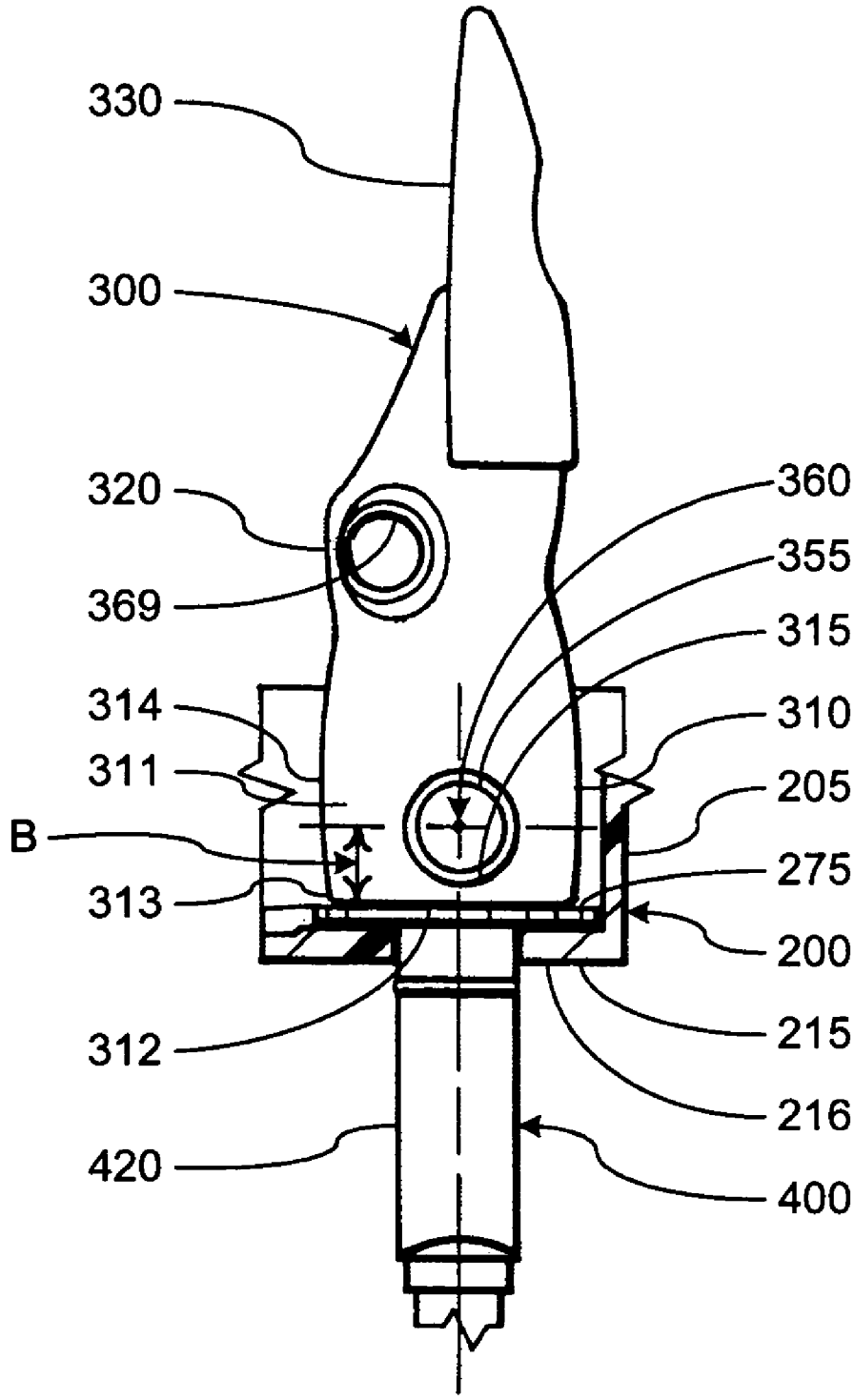
FIG. 10 is a side elevational view similar to FIG. 9, but with the handle pivoted to its extended position wherein the handle permits the shaft to move farther rearwardly relative to the housing than is permitted when the handle is in the retracted position of FIG. 9.
Figure 11:
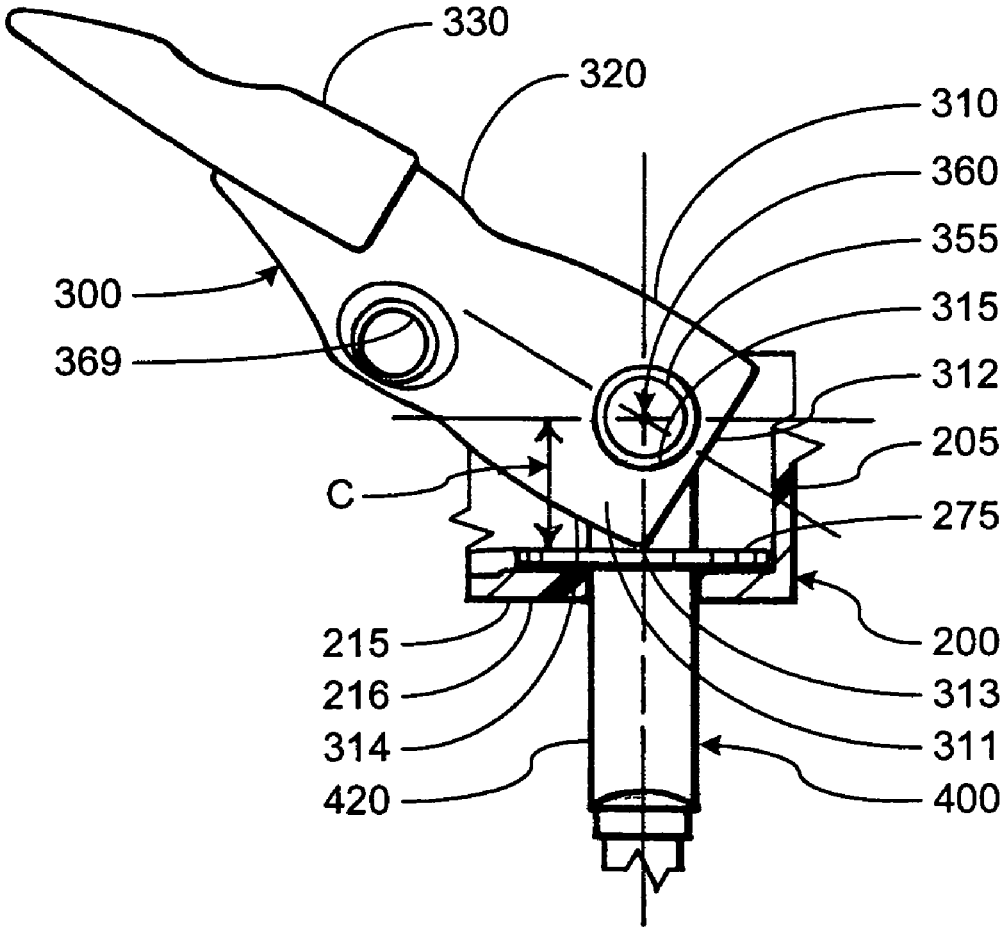
FIG. 11 is a side elevational view similar to FIGS. 9 and 10, but with the handle pivoted to an orientation between its retracted and extended positions wherein the shaft is moved a substantial distance forwardly relative to the housing.

As will now be explained, the handle 300 and the shaft 400 are caused to move forwardly and rearwardly along the principal axis 150 (in response to pivoting of the handle 300 about the transverse axis 360 between the handle's extended and retracted positions) due 1) to the action of a compression coil spring 550 (see FIG. 3) which encircles the shaft 400 at a location just behind the housing 200—a spring that causes the handle 300 and the shaft 400 to be biased rearwardly along the principal axis 150—and due 2) to the action of cam-like surfaces that are defined by the legs 311 of the handle's yoke formation 310—cam-like engagement surfaces that engage the front face of a washer 275 (see FIG. 3) which encircles the shaft 400 at a location adjacent the front side of the back wall 215 of the housing 200. Referring to FIGS. 9-11, the cam-like engagement surfaces that are defined by each of the yoke legs 311 include substantially flat surfaces 312 that extend in a common first imaginary plane, substantially flat surfaces 314 that extend in a common second imaginary plane that is substantially perpendicular to the first imaginary plane, and rounded corner formations 313 that join the flat surfaces 312 to adjacent ones of the flat surfaces 314.

How the handle 300 is oriented relative to the housing 200 determines which of the engagement surfaces 312, 313, 314 of the handle-carried cam formation engage the front surface of the washer 275. By way of three examples, in FIG. 9 the handle 300 is shown in its retracted position wherein the flat surfaces 314 are caused to engage the front face of the washer 275; in FIG. 10 the handle 300 is shown in its extended position wherein the flat surfaces 312 are caused to engage the front face of the washer 275; and, in FIG. 11 the handle 300 is shown intermediate the retracted and extended positions wherein the corner surfaces 313 are caused to engage the front surface of the washer 275.

Because the washer 275 is supported by its engagement with the front surface of the back wall 215 of the housing 200, and because the front surface of the washer 275 is engaged at all times either by the handle-carried cam formation (i.e., by the flat surfaces 312, the flat surfaces 314 or the curved corner surfaces 313 which, taken together, provide a handle-carried cam formation), the front surface of the washer 275 can be thought of as defining a housing-carried engagement surface against which the spring 550 causes the handle carried engagement surfaces 312, 313, 314 to press as the handle 300 pivots between its retracted and extended positions.

A camming action that causes forward and rearward movements of the shaft 400 along the principal axis results from the action of the spring 550 which causes the handle to press one of the engagement surfaces 312, 313, 314 of each of the yoke legs 311 against the front face of the washer 275 as the handle 300 pivots between its retracted and extended positions. This camming action can easily be observed by comparing the distance of the transverse axis 360 from the front face of the washer 275—a distance that changes as the handle 300 pivots about the transverse axis—a distance that is indicated in FIG. 9 by the dimension "A," that is indicated in FIG. 10 by the smaller dimension "B," and that is indicated in FIG. 11 by the much larger dimension "C."

When the handle 300 is in the retracted position of FIGS. 1 and 9, the fact that the surfaces 314 engage the washer 275 causes the rearwardly biased shaft 400 to be positioned more forwardly along the principal axis 150 than is the case when the handle 200 is in the extended position of FIGS. 2 and 10 wherein the surfaces 312 engage the washer 275 causing the rearwardly biased shaft 400 to be positioned less far forwardly (as becomes quite apparent when one compares the FIG. 9 distance "A" between the axis 360 and the washer 275 with the lesser FIG. 10 distance "B" between the axis 360 and the washer 275). As the handle 300 pivots between the retracted and extended positions, the engagement of the corner surfaces 313 with the washer 275 (as depicted in FIG. 11) pulls the rearwardly biased shaft 400 significantly farther forward along the principal axis 150 (compare the FIG. 11 distance "C" between the axis 360 and the washer 275 with the lesser distances "A" and "B" of FIGS. 9 and 10).

The rearward biasing action of the spring 550 on the shaft 400 causes the handle 300 to be biased rearwardly and affects how the handle 300 behaves as it is pivoted between the retracted and extended positions of FIGS. 9 and 10. When the handle 300 is in the "inbetween" position depicted in FIG. 11, the rearward biasing action of the spring 550 does little if anything to cause the handle 300 to be biased toward either of its retracted or extended positions. However, as the handle 300 is pivoted toward and more closely approaches one of its retracted or extended positions, the biasing action of the spring 550 has a much more pronounced affect, causing the handle 300 to be biased forcefully toward the retracted or extended position that is being approached—a biasing action that tends to cause the handle to move rather quickly toward and to snap the handle into the retracted or extended position being approached, where the handle 300 tends to remain seated due to the biasing action of the spring 550.

Figure 14:
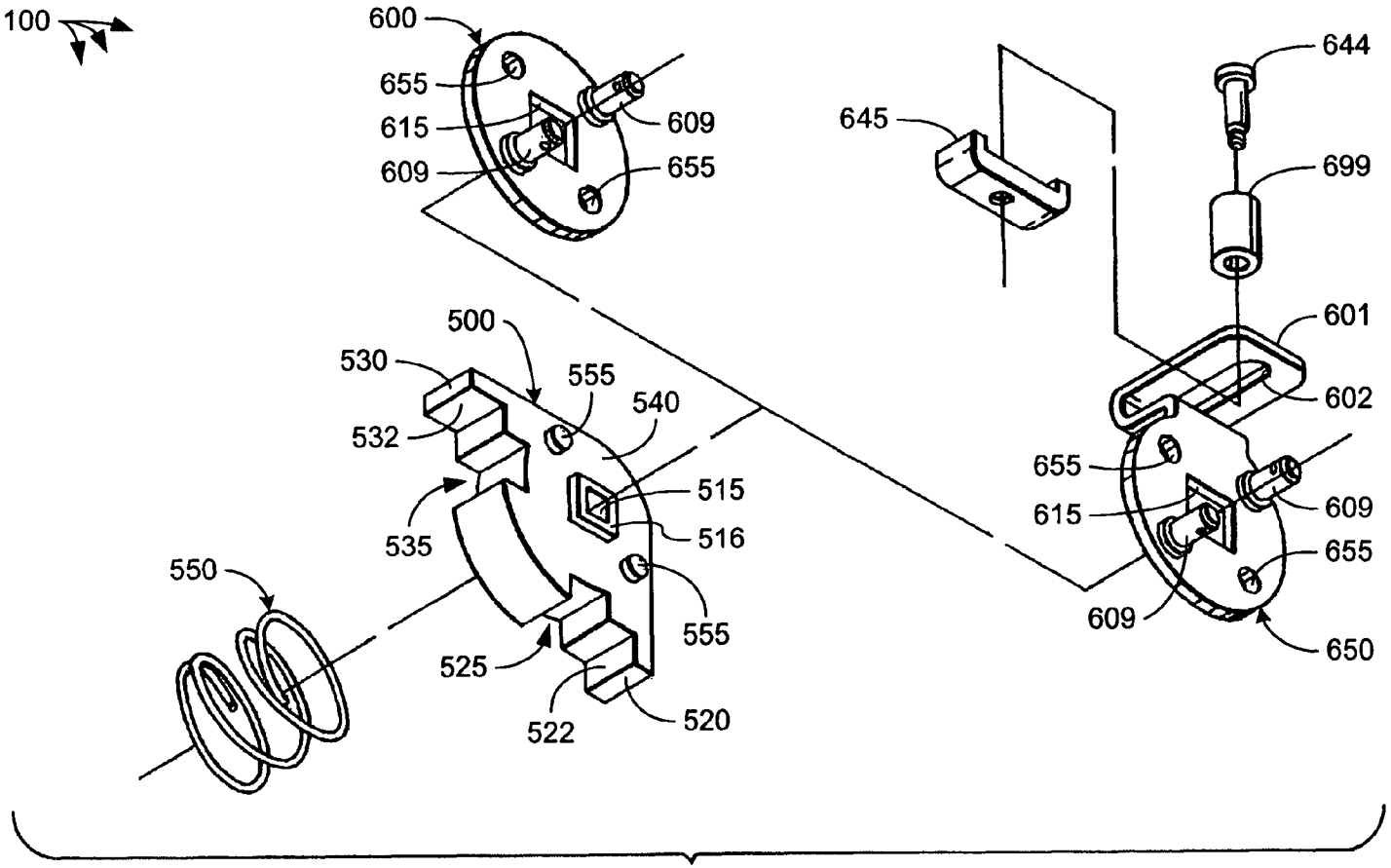
FIG. 14 is an exploded perspective view showing selected rear components of the handle and housing assembly, including a control member, a spring, a latch operating element and a combination latch element and latch operating element.

In some embodiments of the present invention, the forward/rearward movement of the shaft 400 that takes places as the handle is pivoted between the retracted and extended positions of FIGS. 1 and 2 is utilized to effect forward/rearward movement of a latch member 699, shown in FIGS. 14-16. In preferred practice, the latch element 699 is a generally cylindrical roller carried by a shoulder screw 644 that extends through a slot 602 formed in a U-shaped end region 601 of a "combination latch element and latch operating element" 650 (also referred to as a "combo element") that can be mounted on a rear portion 430 of the shaft 400 adjacent the control member 500, as will be described in greater detail. The shoulder screw 644 is threaded into a member 645 that can be moved along the slot 602 when the shoulder screw 644 is loosened, and can be tightened when the roller-type latch member 699 is properly positioned for engagement with a conventional strike (not shown) or other structure (not shown) that can be engaged by the latch member 699 to hold closed a closure (not shown) on which the handle and housing assembly 100 is mounted.

In effect, the latch member 699 (which can be moved forwardly and rearwardly with the shaft 400 in response to pivoting of the handle 300 between its retracted and extended positions, and which can be turned about the principal axis 150 by the shaft 400 as the shaft 400 is turned about the axis 150 by the handle 300) provides what is well known to those skilled in the art as a "compression latch" that can be used to clamp a closure closed, and that often is used to clamp a closure closed against a resilient gasket that is compressed as the closure is clamped closed. Because the shaft 400 moves forwardly as the handle 300 is pivoted from the extended position of FIGS. 2 and 10 to the retracted position of FIGS. 1 and 9 (compare the distance "B" in FIG. 10 with the distance "A" in FIG. 9 to see that the shaft 400 is situated more forwardly when the handle 300 is in the retracted position than when the handle 300 is in the extended position), the roller-type latch member 699 also is caused to move forwardly as the handle 300 pivots from the extended to the retracted position—a forward movement that can be used to clamp a closure closed, as will be understood by those skilled in the art.

In preferred practice, the shaft 400 is formed as a one-piece member from metal. Referring to FIG. 3, the shaft 400 has a generally cylindrical central portion 420 that is configured to be received in a slip fit in the housing passage 250. The slip fit of the central portion 420 within the passage 250 permits the shaft 400 to turn about, and to move forwardly and rearwardly along, the principal axis 150 relative to the housing 200. To minimize the passage of moisture, dust, dirt and the like through the passage 250, an O-ring 290 is installed in a groove provided on the central portion 420 of the shaft 400.

The central portion 420 of the shaft 400 is connected by a rearwardly facing shoulder 421 to a rear portion 430 of the shaft 400. The rear portion 430 provides a non-threaded region 432 of that is of generally square cross-section, and a rearmost threaded region 434 which also is of generally square cross section. A washer 498 and a nut 499 are provided for installation on the rear portion 430 at a time after other shaft-encircling components are moved into position along the shaft 400, as will be explained shortly.

In preferred practice, the control member 500 is formed as a one-piece member from metal. Referring to FIGS. 3 and 14, the control member 500 has a generally cylindrical central portion 540 that extends about the principal axis 150. A square hole 515 is formed through the central portion 540, and is sized to permit the square cross-section of the rear portion 430 of the shaft 400 to be received therein in a slip fit. Portions of the control member 500 that surround the square opening 515 engage the shoulder 421 of the shaft 400 and are clamped into engagement with the shoulder 421 when the nut 499 is threaded onto the threaded end region 434 of the rear portion 430 of the shaft 400 and tightened in place.

The square configuration of the hole 515, and the square cross-section of the rear portion 430 of the shaft 400 cooperate to enable the control member 500 to be installed on the shaft 400 in more than one orientation. For example, two of the opposed side surfaces of the square hole 515 may engage a selected pair of opposed side surfaces of the square shaft region 430 when the control member 500 is installed on the shaft 400 in one orientation; or, the same two opposed side surfaces of the square hole 515 may engage a different pair of opposed side surfaces of the square shaft region 430 when the control member 500 is installed on the square shaft region 430 in a different orientation. This possibility of orienting the control member 500 differently by installing the square hole 515 in different orientations on the square shaft region 430 provides the possibility that the control member can be turned to a desired orientation by turning the handle and the shaft clockwise or counter-clockwise about the principal axis—a possibility that also is present where similar components are utilized with the invention of the referenced Parent Patent, and which is explained in greater detail in the referenced Parent Patent, the disclosure of which is incorporated herein by reference.

Moreover, the possibility of installing the control member 500 in different orientations on the shaft 400 makes it possible to assemble the components of the assembly 100 so that the handle 300 may be turned either clockwise or counter-clockwise about the principal axis 150 to bring the handle 300 to an orientation where the handle can be folded about the transversely extending pivot axis 360 to nest within the housing-defined, forwardly facing recess 220—a feature that also is discussed at greater length in the referenced Parent Patent, the disclosure of which is incorporated herein by reference.

The central portion 540 of the control member 500 defines a forwardly facing recess 510 into which a rear end region of the compression coil spring 550 extends. The spring 550 is interposed between the control member 500 and the back wall 215 of the housing 200, and biases the control member 500, the shaft 400, the handle 300 (and/or other shaft-connected components) as has been explained previously.

The arms 520, 530 of the control member 500 extend perpendicularly from the periphery of the central portion 540 of the control member 500, and give the control member 500 its generally L-shaped appearance. As previously discussed, the surfaces 522, 532 of the arms 520, 530 engage one or the other of the rearwardly projecting formations 272, 273 of the housing 200 when the control member 500 is pivoted about the principal axis 150 to opposite ends of the permitted range of turning movement of the control member 500.

For retaining the control member 500 either in one orientation depicted in FIGS. 5-7 and 12 or in another orientation depicted in FIGS. 8 and 13, the control member 500 is provided with notches 525, 535 that are spaced along a curved exterior of the central portion 540. The notch 525 is adjacent the arm 520, whereas the notch 535 is adjacent the arm 530. When the control member 500 is turned to one or the other of the orientations depicted in FIGS. 5-8 or 12-13 so that one of the notches 525, 535 is aligned with the path of travel 850 of the lock bolt 800, this permits the lock bolt 800 to move along the path of travel 850 toward the principal axis 150 to cause a head portion 810 of the lock bolt 800 to extend into the one of the notches 525, 535 that is aligned with the path of travel 850; and, when the head portion 810 of the lock bolt 800 is received in one of the notches 525, 535, the control member 500 is prevented from turning about the principal axis 150—which means that the handle 300, the shaft 400, and any other elements connected to the shaft 400 also are prevented from turning about the principal axis 150. Retraction of the lock bolt 800 from the notches 525, 535 permits the control member 500, to turn about the principal axis 150 with the shaft 400 and the handle 300.

Referring to FIG. 14, a square collar 516 and a pair of pin-like formations 555 project rearwardly from the central portion 540 of the control member 500 to provide a simple means of drivingly connecting the control member 500 to one or more other components. The collar 516 surrounds the square opening 515. The pin-like formations 555 are located on opposite sides of the collar 516, spaced substantially equidistantly from the principal axis 150.

Referring to FIG. 14, one component that can be drivingly connected to the control member 500 is a latch operating element 600. Another is the previously mentioned combination latch element and latch operating element 650 (referred to as a "combo element" for short). Each of the latch element 600 and the combo element 650 has a square, centrally located hole 615 configured to receive therein the square collar 516 formed on the rear of the control member 500, and each is provided with a pair of round holes 655 configured to receive therein the round formations 555 that extend rearwardly from the control member 500 to establish a driving connection between the control member 500 and whichever one of the elements 600, 650 is installed thereon.

Referring still to FIG. 14, each of the elements 600, 650 carries a pair of rearwardly projecting pins 609 at locations on opposite sides of the principal axis 150—pins that are well suited for connection with end regions of elongate links 700, in the manner depicted in FIGS. 12, 13 and 16. When the elements 600, 650 are caused to turn a quarter-turn about the principal axis 150 due to the handle 300 being turned, while extended, a quarter turn (compare the position of the extended handle 300 as depicted in FIG. 7 with the quarter-turned orientation of the extended handle 300 as depicted in FIG. 8), the end regions of the links 700 are caused to move in opposite directions (left and right as viewed in FIGS. 12, 13 and 16). Compare the positions of the end regions of the links 700 as shown in FIGS. 12 and 13 to see the repositioning effect on the link end regions that is caused by a quarter turn of one of the elements 600, 650.

As has been explained previously, and as also is described in many of the aforementioned patents and applications, link movements of the type just described are well suited to cause remotely located link-connected latches (not shown) to be operated in response to turning of the handle 300 of the handle and housing assembly 100. And, as is disclosed in the aforementioned provisional application and as is well known to those skilled in the art, such link movements also may be used to move roller assemblies into and out of engagement with strikes or other structure to selectively retain closures in their closed positions.

The lock bolt 800 preferably is formed as a one-piece member from metal. Referring to FIG. 3, the lock bolt 800 has the previously mentioned head portion 810 which is coupled by a central portion 820 to a control portion 830. The rearwardly projecting formations 272, 273 of the housing 200 engage opposite sides of the central portion 820 to guide movements of the lock bolt 800 along the path of travel 850 between the locked position of FIGS. 5, 6, 12, 15 and 16, and the unlocked position of FIGS. 7, 8 and 13, and other elements of the assembly 100 engage other features of the lock bolt 800 (as has been described above) to assist is guiding the lock bolt 800 along the travel path 850. When in the locked position, the head portion 810 extends into one of the control member notches 525, 535; and, when in the unlocked position, the head portion 810 disengages the control member 500.

Movement of the lock bolt 800 along the path of travel 850 is effected by the key-operated lock mechanism 900 which has a cam 905 that pivots between the locked position shown in FIGS. 5, 6, 12, 15 and 16, and the unlocked position shown in FIGS. 7, 8 and 13. The cam 905 engages internal surfaces of the control portion 830 of the lock bolt as the cam 905 turns between its locked and unlocked positions, and retains the lock bolt 800 in locked and unlocked positions when the cam 905 is in its locked and unlocked positions, respectively. Typically the cam 905 turns a half turn in order to cause the lock bolt 800 to move along the travel path 850 between locked and unlocked positions—a type of camming action causing a type of lock bolt movement that is well known in the art.

Taken together, the lock bolt 800 and the cam-carrying key-operated lock mechanism 900 provide a housing carried lock that can be used to prevent or permit turning of the shaft 400 about the principal axis as by selectively retaining the control member 500 in orientations at opposite ends of its permitted range of turning movement, or by permitting the control member 500 to turn about the principal axis 150.

By selecting from among a variety of components that may be connected to the control member 500 to be turned therewith about the principal axis 150, one can select various functions to be performed by the handle and housing assembly 100. If the combo element 650 is used with no elongate links attached thereto, the assembly 100 can serve as a so-called "single point" latch. If one or two elongate links are connected to latch operating element 600, the assembly 100 can operate one or more remotely located latches or reposition one or more remotely located roller assemblies. If a pair of elongate links are connected to the combo element 650, the assembly can be used to provide a "three point" latching system, with the latch member 699 providing a local latch, and with the links operating a pair of remotely located latches.

The latch element 600 and the combo element 650 represent only two of many types of components that may be connected to the control member 500. Those who are skilled in the art will readily understand that other types of components may be connected to the control member 500 to perform functions other than what can be accomplished utilizing the elements 600, 650.

As will be apparent from the foregoing description taken together with the accompanying drawings and claims, the present invention provides a solidly and reliably constructed handle and housing assembly that is quite versatile in the uses to which it may be put. The assembly is constructed to be water resistant and to provide a handle that is easy to grasp and reposition even for persons wearing gloves. The padlockability of the handle is well suited for use with handle and housing assemblies employed on rental vehicles and rental machinery where the persons renting the vehicle or machinery desire to install their own padlocks rather than to rely on housing-carried locks to which others may possess keys; and, the inclusion of housing carried locks gives the owners of the vehicles or machinery a simple way to lock their possessions, especially when the housing carried locks on plural pieces of equipment are keyed alike.

The use of a nested handle to protectively cover front portions of a key-operated lock enhances the combination of features that can be included in handle and housing assemblies that embody the present invention. The use of fasteners installed on the rear side of the assembly to clamp the assembly in place to provide an attractive and secure mounting of the assembly on a closure further enhances the appeal that can be offered by assemblies that embody the preferred practice of the invention.

In operation, the handle 300 can be pivoted from the retracted position of FIG. 1 to the extended position of FIG. 2 so long as no padlock is installed on the stem portion 320 of the handle 300; and, the handle 300 can be turned between the extended positions shown in FIGS. 7 and 8 so long as the head portion 810 of the lock bolt 800 is not seated in one of the notches 525, 535 of the control member 500. To return the handle 300 to its retracted position shown in FIG. 1, the extended handle 300 must first be turned to the orientation depicted in FIGS. 2 and 7, and any key inserted into the keyway 915 of the lock 900 must be removed therefrom to enable the handle 300 to be pivoted about the transverse axis 360 to the retracted position of FIG. 1. Other aspects of the operation of the handle and housing assembly 100 have already been described as features of components involved therewith were explained.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention. It is intended that the patent shall cover by suitable expression in the appended claims whatever features of patentable novelty exist in the invention disclosed.

What is claimed is:

1. A handle and housing assembly, comprising:

a) a housing having a front side and a rear side, and a mounting flange that surrounds a border of a forwardly facing recess defined by the housing wherein the forwardly facing recess has a relatively small sized, relatively shallow portion in an end region of the forwardly facing recess removed from where a forwardly-rearwardly extending principal axis extends through a relatively large sized, relatively deep portion of the forwardly facing recess, wherein the end region of the forwardly facing recess that defines the relatively shallow portion of the forwardly facing recess is located along the border of the forwardly facing recess in a region of the forwardly facing recess that is exterior to and outside of the relatively deep portion of the forwardly facing recess;

b) a shaft extending along the principal axis through the housing and into the relatively deep portion of the forwardly facing recess and being turnable relative to the housing about the forwardly-rearwardly extending principal axis;

c) a handle having a relatively wide graspable portion joined to and supported by a relatively narrow stem portion that is connected on the front side of the housing to the shaft to permit movement of the handle relative to the shaft between a retracted position nesting in the recess near the housing with the relatively wide graspable portion overlying a majority of the relatively shallow portion of the forwardly facing recess, and an extended position projecting forwardly from the housing with the graspable portion extending forwardly from the forwardly facing recess to facilitate grasping and turning of the handle to turn the shaft about the principal axis between first and second orientations, and wherein the stem portion of the handle has spaced parts between which is defined a passage configured to open rearwardly into the forwardly facing recess and to not open forwardly when the handle is in the retracted position;

d) a forwardly extending projection on the front side of the housing configured to extend into the passage between the spaced parts of the stem portion of the handle and to thereby be concealed from view when the handle is in the retracted position; and, e) openings formed through the spaced parts of the stem portion that are configured to align with an opening formed through the forwardly extending projection when the handle is in the retracted position to permit a component of a padlock to be inserted through the openings formed through the spaced parts and the opening formed through the forwardly extending projection to retain the handle in the retracted position.

2. The assembly of claim 1 further comprising a key-operated lock connected to and extending through the housing into the shallow portion of the forwardly facing recess and lockable to inhibit turning of the shaft about the principal axis.

3. The assembly of claim 2 wherein the graspable portion of the handle provides a handle-defined recess that opens rearwardly to protectively receive therein at least a part of the front portion of the key-operated lock therein when the handle is in the retracted position.

4. The assembly of claim 1 further comprising a control member connected to the shaft on the rear side of the housing for being turned about the principal axis together with the handle and the shaft between the first and second orientations, and being engageable with a first housing carried formation when in the first orientation.

5. The assembly of claim 4 wherein the control member is engageable with a second housing carried formation when in the second orientation, and wherein the engagement of the control member with the first and second housing carried formations defines a range of motion through which the handle, the shaft and the control member are permitted to turn when moving between the first and second orientations.

6. The assembly of claim 5 further comprising a lock bolt on the rear side of the housing movable along a path of travel between a non-operated position disengaging the control member and an operated position engaging the control member to retain the control member, the shaft and the handle in a selected one of the first and second orientations.

7. The assembly of claim 1 wherein the housing defines a rear wall at the rear of the forwardly facing recess, and wherein a locking element formed separately from the housing extends through a slot-like opening of the rear wall to define the forwardly extending projection on the front side of the housing.

8. The assembly of claim 7 wherein the forwardly facing recess of the housing is configured to permit movement of the handle between the extended and retracted positions only when the handle and the shaft are turned about the principal axis to a particular orientation.

9. The assembly of claim 1 wherein the graspable portion of the handle defines a relatively long convexly curved surface, and wherein a portion of the housing bordering the relatively shallow portion of the forwardly facing recess has a relatively long concavely curved surface that faces toward the principal axis and is configured to extend closely alongside the convexly curved surface of the graspable portion of the handle when the handle is in the retracted position.

10. A handle and housing assembly, comprising:

a) a housing having a front side and a rear side, and having a mounting flange extending about a forwardly facing recess that has a perimeter along which extends a side wall that connects the mounting flange to a back wall of the housing that extends behind a relatively large sized, relatively deep portion and a relatively small sized, relatively shallow portion of the forwardly facing recess located in an end region of the recess removed from where a forwardly-rearwardly extending principal axis extends through the back wall into the relatively deep portion of the forwardly facing recess, wherein the end region of the forwardly facing recess that defines the relatively shallow portion of the forwardly facing recess is located along the border of the forwardly facing recess in a region of the forwardly facing recess that is exterior to and outside of the relatively deep portion of the forwardly facing recess;

b) a shaft extending along the principal axis through the housing into the relatively deep portion of the forwardly facing recess and being turntable relative to the housing about the forwardly-rearwardly extending principal axis;

c) a handle having a relatively wide graspable portion joined to and supported by a relatively narrow stem portion that is pivotally connected on the front side of the housing to the shaft to permit movement of the handle between a retracted position nesting in the forwardly facing recess with the relatively wide graspable portion of the handle overlying a majority of the relatively shallow portion of the forwardly facing recess, and an extended position wherein the graspable portion of the handle extends forwardly from the forwardly facing recess to facilitate grasping and turning the handle to turn the shaft about the principal axis between first and second orientations;

d) a key-operated lock connected to the housing and having a front part i) extending through the back wall into the shallow portion of the forwardly facing recess, ii) defining a keyway into which a key can be inserted and turned when the handle is in the extended position to selectively permit and prevent turning of the shaft about the principal axis, and arranged to extend into a recess defined by the graspable portion of the handle and configured to open rearwardly to receive the front part of the key-operated lock therein when the handle is in the retracted position thereby causing the front part of the key-operated lock to be protectively covered by and concealed from view by the graspable portion of the handle when the handle is in the retracted position; and, e) a handle-connected formation defined by the stem portion of the handle and defining a passage configured to open rearwardly into the relatively deep portion of the forwardly facing recess and to not open forwardly when the handle is in the retracted position to receive therein a housing-connected formation on the front side of the housing when the handle is in the retracted position, with the handle-connected formation and the housing-connected formation having holes formed therethrough that align when the handle is in the retracted position and that are configured to receive a component of a padlock therein when the handle is in the retracted position to retain the handle in the retracted position.

11. The assembly of claim 10 wherein the handle-connected formation has spaced portions between which the housing-connected formation extends when the handle is in the retracted position, and wherein holes extend through the spaced portions and through the housing connected formation that align when the handle is in the retracted position to receive a hasp of a padlock therein to retain the handle in the retracted position.

12. The assembly of claim 10 wherein the forwardly-facing recess is configured to permit the handle to move to and from the retracted position only when the handle and the shaft are turned about the principal axis to a predetermined orientation.

13. The assembly of claim 10 further comprising a control member connected to the shaft on the rear side of the housing for being turned about the principal axis together with the handle and the shaft between the first and second orientations, and being engageable with a first housing carried formation when in a chosen one of the first and second orientations.

14. The assembly of claim 13 wherein the control member is engageable with a second housing carried formation when in the second orientation, and wherein the engagement of the control member with the first and second housing carried formations defines a range of motion through which the handle, the shaft and the control member are permitted to turn when moving between the first and second orientations.

15. The assembly of claim 14 further comprising a lock bolt on the rear side of the housing movable along a path of travel between a non-operated position disengaging the control member and an operated position engaging the control member to retain the control member, the shaft and the handle in a selected one of the first and second orientations, with movement of the lock bolt along the path of travel occurring in response to turning of a key inserted into a keyway of the key-operated lock.

16. A handle and housing assembly, comprising:

a) a housing having a front side and a rear side, and a mounting flange that surrounds a border of a forwardly facing housing-defined recess having a relatively small sized, relatively shallow portion in an end region of the forwardly facing recess removed from where a forwardly-rearwardly extending principal axis extends through the housing into a relatively large sized, relatively deep portion of the forwardly facing recess, wherein the end region of the forwardly facing recess that defines the relatively shallow portion of the forwardly facing recess is located along the border of the forwardly facing recess in a region of the forwardly facing recess that is exterior to and outside of the relatively deep portion of the forwardly facing recess;

b) a shaft extending through the housing along the principal axis into the relatively deep portion of the forwardly facing recess and being turnable relative to the housing about the principal axis;

c) a generally T-shaped handle on the front side of the housing having a relatively narrow, elongate stem portion that supports and extends from a relatively wide graspable portion of the handle to a location in the forwardly facing recess where a handle-to-shaft connection pivotally connects the elongate stem portion to the shaft for pivotal movement between a retracted position wherein the relatively wide graspable portion of the handle overlies a majority of the relatively shallow portion of the forwardly facing recess and nests in the relatively shallow portion of the forwardly facing recess, and an extended position wherein the relatively wide graspable portion extends forwardly from the relatively deep portion of the forwardly facing recess;

d) a handle-defined recess defined by the graspable portion of the handle and configured to open rearwardly and to not open forwardly when the handle is in the retracted position; and, e) a key-operated lock cylinder extending through the housing and having a keyway-defining front portion on the front side of the housing that is configured to extend into the handle-defined recess when the handle is in the retracted position whereby the graspable portion of the handle protectively covers and conceals from view the front portion of the lock cylinder, and the handle-defined recess protectively covers a keyway defined by the front portion of the lock cylinder when the handle is in the retracted position.

17. The assembly of claim 16 further comprising a control member connected to the shaft on the rear side of the housing for being turned about the principal axis with the handle and the shaft, and a lock bolt on the rear side of the housing and movable by the key-operated lock cylinder relative to the housing between a non-operated position disengaging the control member, and an operated position engaging the control member to inhibit turning about the principal axis of the handle, the shaft and the control member.

18. A handle and housing assembly, comprising: a housing having a front side and a rear side, and defining a forwardly facing recess surrounded by a mounting flange, wherein the forwardly facing recess has a relatively small sized, relatively shallow portion in an end region of the forwardly facing recess that is exterior to and outside of a relatively large sized, relatively deep portion of the forwardly facing recess and removed from where a forwardly-rearwardly extending principal axis extends through the relatively deep portion of the forwardly facing recess; a shaft extending along the principal axis through the housing into the relatively deep portion of the forwardly facing recess and being turnable about the principal axis of the housing between first and second orientations; a handle having a relatively wide graspable portion joined to and supported by a relatively narrow stem portion that is pivotally connected to the shaft on the front side of the housing in the relatively deep portion of the forwardly facing recess for turning the shaft about the principal axis between first and second orientations, with the handle being movable relative to the shaft to and from a retracted position nesting in the forwardly facing recess near the housing with the relatively wide graspable portion overlying a majority of the relatively shallow portion of the forwardly facing recess, and an extended position projecting forwardly from the housing with the graspable portion extending forwardly from the forwardly facing recess to facilitate grasping and turning the handle to turn the shaft about the principal axis between said first and second orientations; a handle-carried recess defined by the relatively wide graspable portion of the handle and configured to open rearwardly into the forwardly facing recess and to not open forwardly when the handle is in the retracted position; a key-operated lock cylinder extending through the housing into the relative shallow portion of the forwardly facing recess and having a keyway-defining front portion on the front side of the housing configured to extend into the handle-carried recess that opens rearwardly, not forwardly, to be protectively covered and concealed from view by the relatively wide graspable portion of the handle when the handle is in the retracted position; and, formations carried by the housing and by the relatively narrow stem portion of the handle that are configured to extend side by side within the relatively deep portion of the forwardly facing recess and are configured to be padlockable together when the handle is in the retracted position to retain the handle in the retracted position.

19. The assembly of claim 18 further comprising holes formed through the formations carried by the housing and by the handle that align when the handle is in the retracted position to enable a hasp of a padlock to be inserted therethrough to retain the handle in the retracted position.

20. The assembly of claim 18 further comprising a control member connected to the shaft on the rear side of the housing for being turned about the principal axis together with the handle and the shaft between a first orientation and a second orientation.

* * * * *